US006978211B2

(12) United States Patent
Soliman et al.

(10) Patent No.: US 6,978,211 B2
(45) Date of Patent: Dec. 20, 2005

(54) METHODS AND SYSTEMS FOR USING WAVELET ANALYSIS IN SUBTERRANEAN APPLICATIONS

(75) Inventors: Mohamed Y. Soliman, Cypress, TX (US); Joseph Ansah, Sugar Land, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 126 days.

(21) Appl. No.: 10/730,418

(22) Filed: Dec. 8, 2003

(65) Prior Publication Data

US 2005/0125156 A1 Jun. 9, 2005

(51) Int. Cl.[7] ..... E21B 47/00
(52) U.S. Cl. ..... 702/13
(58) Field of Search ..... 702/12, 13; 324/303, 324/306; 73/152.02, 152.03, 152.28, 152.39; 166/252.1, 252.5, 252.4, 370, 369; 706/929

(56) References Cited

U.S. PATENT DOCUMENTS

| | | | | |
|---|---|---|---|---|
| 4,802,144 A | | 1/1989 | Holzhausen et al. | 367/35 |
| 5,050,674 A | | 9/1991 | Soliman et al. | 166/250 |
| 5,305,211 A | | 4/1994 | Soliman | 364/422 |
| 5,996,726 A | * | 12/1999 | Sorrells et al. | 181/106 |
| 6,076,046 A | | 6/2000 | Vasudevan et al. | 702/12 |
| 6,236,943 B1 | * | 5/2001 | Aminzadeh et al. | 702/16 |
| 6,343,507 B1 | * | 2/2002 | Felling et al. | 73/152.19 |
| 6,347,283 B1 | | 2/2002 | Soliman et al. | 702/6 |
| 6,442,489 B1 | * | 8/2002 | Gendelman et al. | 702/12 |
| 6,585,044 B2 | | 7/2003 | Rester et al. | 166/250.01 |
| 6,609,067 B2 | * | 8/2003 | Tare et al. | 702/9 |
| 2004/0206494 A1 | * | 10/2004 | Stephenson et al. | 166/250.1 |

OTHER PUBLICATIONS

SPE 71571 "Application of Wavelet Transform to Analysis of Pressure Transient Data" by M. Y. Soliman, et al., 2001.
SPE 71367 "Pump-in/Flowback Tests Reduce the Estimate of Horizontal in-Situ Stress Significantly" by A. M. Raaen, et al., 2001.
SPE 14263 "Prediction of Formation Response From Fracture Pressure Behavior" by M. W. Conway, et al., 1985.
SPE 8297 "Interpretation of Fracturing Pressures" by Kenneth G. Nolte, et al., Sep. 1981.
U.S. Appl. No. 10/251,301, filed Sep. 20, 2002, Stephenson et al., entitled "Fracture Monitoring Using Pressure-Frequency Analysis".

* cited by examiner

*Primary Examiner*—Donald McElheny, Jr.
(74) *Attorney, Agent, or Firm*—Robert A. Kent; Baker Botts

(57) ABSTRACT

The present invention provides methods of monitoring the injection of a fluid into a subterranean formation. The present invention also provides a method of fracturing a subterranean formation. All methods feature the use of a wavelet transform of data generated by the subterranean injection process.

90 Claims, 10 Drawing Sheets

METHODS AND SYSTEMS FOR USING WAVELET ANALYSIS IN SUBTERRANEAN APPLICATIONS

BACKGROUND OF THE INVENTION

The present invention relates generally to subterranean treatment operations, and more particularly to using wavelet analysis in subterranean treatment operations.

Subterranean formations penetrated by well bores are often treated to increase the production therefrom. Common treatment methods include water-flooding, carbon dioxide ($CO_2$) flooding, conformance applications, and fracture stimulation, among others. When a fluid is injected into a subterranean formation, certain changes occurring downhole during such injection process (such as the creation or extension of a fracture therein or the contacting of a subterranean boundary by the injected fluid, for example) send different pressure frequency spectra and wave intensities to the surface. Pressure waves generated and reflected during fluid injection are conventionally captured and evaluated so as to monitor changes in the downhole environment during the time period in which the fluid is injected.

Monitoring and analysis techniques used in conventional water-flooding and/or $CO_2$-flooding operations often encounter difficulty in recognizing certain subterranean conditions such as boundaries or heterogeneities (e.g., regions of high permeability into which the injected fluid may flow readily, thereby creating undesirable "fingering") within the subterranean formation. This difficulty is problematic, because it prevents operators from prompt execution of a remediative step, such as adjusting the viscosity of the injected fluid.

Monitoring and analysis techniques conventionally used in conformance applications are also problematic. As referred to herein, the term "conformance applications" will be understood to mean applications comprising the injection of a first fluid into a portion of a subterranean formation so as to alter the flow profile of a second fluid injected into, or produced from, a subterranean formation. For example, a conformance application may involve the injection of a sealant into a subterranean formation so as to minimize entry into a well bore of an unwanted fluid. Monitoring and analysis techniques used in conventional conformance applications often encounter difficulty in recognizing certain subterranean conditions. An example of such a condition is the presence of boundaries within the formation. This difficulty is problematic, because it prevents operators from prompt execution of a remediative step, such as adjusting the pressure of the injected fluid, for example.

Fracture stimulation is another application where conventional monitoring and analysis techniques are problematic. Fracture stimulation comprises the intentional fracturing of the subterranean formation by pumping a fracturing fluid into a well bore and against a selected surface of a subterranean formation intersected by the well bore. The fracturing fluid is pumped at a pressure sufficient that the earthen material in the subterranean formation breaks or separates to initiate a fracture in the formation.

A fracture typically has a narrow opening that extends laterally from the well. To prevent such opening from closing completely when the fracturing pressure is relieved, the fracturing fluid typically carries a granular or particulate material, referred to as "proppant," into the opening of the fracture. This material remains in the fracture after the fracturing process is finished. Ideally, the proppant in the fracture holds apart the separated earthen walls of the formation to keep the fracture open and to provide flow paths through which hydrocarbons from the formation can flow into the well bore at increased rates relative to the flow rates through the unfractured formation. Fracturing processes are intended to enhance hydrocarbon production from the fractured formation. In some circumstances, however, the fracturing process may terminate prematurely, for a variety of reasons. For example, the "pad" portion of the fracturing fluid, which is intended to advance ahead of the proppant as the fracture progresses, may undesirably "leak off" into smaller fractures in the formation, which may cause the proppant to reach the fracture tip and create an undesirable "screenout" condition. Thus, properly analyzing fracture behavior is a very important aspect of the fracturing process.

In connection with analyzing fracture behavior, various physical parameters of the subterranean formation are commonly monitored. Physical parameters such as pressure and temperature are commonly converted into electronic signals with downhole transducers. Conventional fracturing operations typically begin with a determination of the "closure pressure" of the subterranean formation, which determination is often accomplished by performing reduced-scale fracturing, e.g., a "mini-frac" or a "micro-frac," before commencing full-scale fracturing of the formation. For example, in one embodiment of a micro-frac test, a small volume of clear fluid containing no proppant may be pumped into a well bore at a low flowrate (typically less than 10 gallons per minute). This may generate a fracture extending up to about 15 feet into the subterranean formation, and generate acoustic noise in the form of a pressure wave or signal received by a sensing device within the well bore. In one embodiment of a mini-frac test, the formation is fractured using a formulation of the fracturing fluid that will be used in the full-scale fracturing operation. The scale of the mini-frac may be generally about 10–15% of the full-scale fracturing operation, but the fluid used in the mini-frac will generally not contain a significant amount of proppant. Among other benefits, the mini-frac test enables an operator to determine the formation's closure pressure, along with the formation's leakoff coefficient, both of which parameters are useful in designing and analyzing the full-scale fracturing treatment. To determine the closure pressure, an operator may often plot the pressure signal versus the square root of time, and determine the closure pressure by constructing two tangent lines on the plot, and extending them so that they intersect. Typically, one tangent line will be constructed at a point on the graph representing a time immediately after the cessation of injection of the fracturing fluid; the other tangent line will typically be constructed at a point on the graph immediately after a "knee" in the pressure signal. Conventionally, the first tangent line is thought to represent a region of fluid leak-off into the face of an open subterranean fracture, while the second tangent line is thought to represent a region of slower fluid leak-off through a closed subterranean fracture. The two tangent lines are arbitrarily constructed based upon a particular operator's interpretation of a suitable tangent line. Once the two tangent lines have been drawn, their intersection is conventionally identified as the closure pressure of the formation. The method is highly subjective.

Conventionally, full-scale fracturing operations begin once the closure pressure has been determined, and are conventionally analyzed through the use of a log-log plot of a "net-pressure" signal. Upon the initiation of fracturing of the well bore, a pressure signal is received. An operator will typically subtract the pre-determined closure pressure from the pressure signal, to calculate a "net pressure." This net pressure is then plotted versus time on a log-log plot. Conventionally, the slope of the net pressure curve is analyzed with consideration given to certain guidelines. For example, where the slope of the net pressure curve is between about 0.2 and about 0.3, the fracture is thought to be continuing to propagate. However, where the net pressure curve has a slope of about 1.0, the fracture propagation is thought to have stopped, and adverse fracture behaviors such as the onset of sand-out are thought to begin.

Conventional fracturing analysis using the log-log plot of a net pressure curve is problematic. Because of the nature of the log-log plot, a lengthy amount of time is often required before the unit slope straight line becomes well-developed and apparent. Accordingly, an operator may encounter difficulty in interpreting the net pressure curve so as to distinguish, normal, continued fracture propagation from the cessation of propagation. This difficulty may cause operators to continue to inject proppant-laden fracturing fluid into the well bore, despite the fact that the fracture is no longer capable of accepting the proppant; in such scenarios, proppant accumulates within the well bore and must be laboriously removed once the fracturing operation stops. This difficulty in distinguishing between normal fracturing and the cessation of propagation often prevents operators from timely performance of a remediative step. Such a remediative step could comprise injecting a clear fluid into the well bore so as to sweep any last amounts of proppant out of the well bore and into the formation, for example.

An operator using conventional fracture monitoring techniques such as the log-log plot of a net pressure curve may also encounter difficulty in distinguishing a pressure increase caused by actual closure of the fracture from a temporary pressure increase caused by the occurrence in the well bore of an event unrelated to the behavior of the fracture. Such temporary event is often referred to as a "tool event." The occurrence of a temporary tool event appears quite similar on a log-log plot to the occurrence of a formation event such as closure of the fracture. This may lead to the operator misinterpreting the tool event as fracture closure, and thus halting the fracturing operation prematurely. To avoid premature stoppage of the fracture operation, the operator typically must wait, and refrain from taking any action, until a sufficient number of subsequent data points departing from the unit slope have been plotted on the net pressure curve before discounting the tool event as a spurious event not indicative of fracture closure with sufficient confidence; in some scenarios, this may require waiting several tens of minutes. Alternatively, an operator using conventional fracturing analysis techniques and encountering actual fracture closure may misinterpret it as a temporary tool event, and continue to inject proppant into the well bore, while waiting for subsequent data points to depart from the unit slope on the net pressure curve. Such misinterpretation of actual fracture closure as a temporary tool event may result in the well bore becoming loaded with proppant that never reaches the fracture, and that must be laboriously and expensively removed before the well bore may be returned to production.

SUMMARY OF THE INVENTION

The present invention provides improved methods of monitoring and analyzing the subterranean injection of a fluid, through an analysis employing a Wavelet Transform of data generated during such subterranean fluid injection. While the methods of the present invention are useful in a variety of subterranean applications, they may be particularly useful in operations including but not limited to fracture stimulation, conformance applications, and water- or $CO_2$-flooding. The methods of the present invention may be utilized in connection with a fracturing process without the need to conduct a separate mini-frac or micro-frac to determine the fracture closure pressure, though such separate mini- or micro-frac may still be conducted if desired.

An example of a method of the present invention is a method for monitoring the injection of fluid into a subterranean formation, comprising the steps of: injecting a fluid into a region of the subterranean formation surrounding a well bore; creating frequency spectrum data by applying a wavelet transform to physical property data sensed in the subterranean formation during the time in which fluid is injected into the formation; and determining from the frequency spectrum data at least one parameter relating to the fluid injection.

Another example of a method of the present invention is a computer-implemented method for monitoring the injection of fluid into a subterranean formation, comprising the steps of: receiving in a computer physical property data obtained from the injection of a fluid into a region of a subterranean formation surrounding a well bore; performing in the computer a wavelet transform on at least a portion of the physical property data received in the computer to provide frequency spectrum data corresponding to at least a portion of the physical property data; and using the frequency spectrum data to determine at least one parameter relating to the fluid injection process.

Another example of a method of the present invention is a method of fracturing a subterranean formation comprising the steps of: injecting a fracturing fluid into the subterranean formation such that a fracture is created or extended in a region of the formation surrounding a well bore and generates pressure signals; sensing the pressure signals; generating frequency signals corresponding to the pressure signals by applying a wavelet transform to the pressure signals; and determining from the frequency signals whether the fracture is continuing to extend into the formation.

Another example of a method of the present invention is a method of flooding a subterranean formation comprising the steps of: injecting a fluid into a region of the subterranean formation surrounding a well bore so as to maintain or increase the pressure in the formation; creating frequency spectrum data by applying a wavelet transform to physical property data sensed in the subterranean formation during the time in which fluid is injected into the formation; and determining from the frequency spectrum data at least one parameter relating to the fluid injection.

Another example of a method of the present invention is a method of conforming a fluid flow profile in a subterranean formation comprising the steps of: injecting a first fluid into a region of the subterranean formation surrounding a well bore so as to alter the flow profile of a second fluid within the formation; creating frequency spectrum data by applying a wavelet transform to physical property data sensed in the subterranean formation during the time in which fluid is injected into the formation; and determining from the frequency spectrum data at least one parameter relating to the fluid injection.

An example of a system of the present invention is a system for monitoring the injection of fluid into a subterranean formation, comprising a sensing means for detecting physical property data created by the fluid injection; a data analysis means for creating frequency spectrum data by performing a wavelet transform on at least a portion of the physical property data; and a transmitting means for transmitting the physical property data from the sensing means to the data analysis means.

Another example of a system of the present invention is a system for monitoring the injection of fluid into a subterranean formation, comprising a sensor for detecting physical property data created by the fluid injection; a data analyzer for creating frequency spectrum data by performing a wavelet transform on at least a portion of the physical property data; and a transmitter for transmitting the physical property data from the sensor to the data analyzer.

The features and advantages of the present invention will be readily apparent to those skilled in the art upon a reading of the description of exemplary embodiments, which follows.

BRIEF DESCRIPTION OF THE DRAWINGS

A more complete understanding of the present disclosure and advantages thereof may be acquired by referring to the following description taken in conjunction with the accompanying drawing, wherein.

Figure 1:
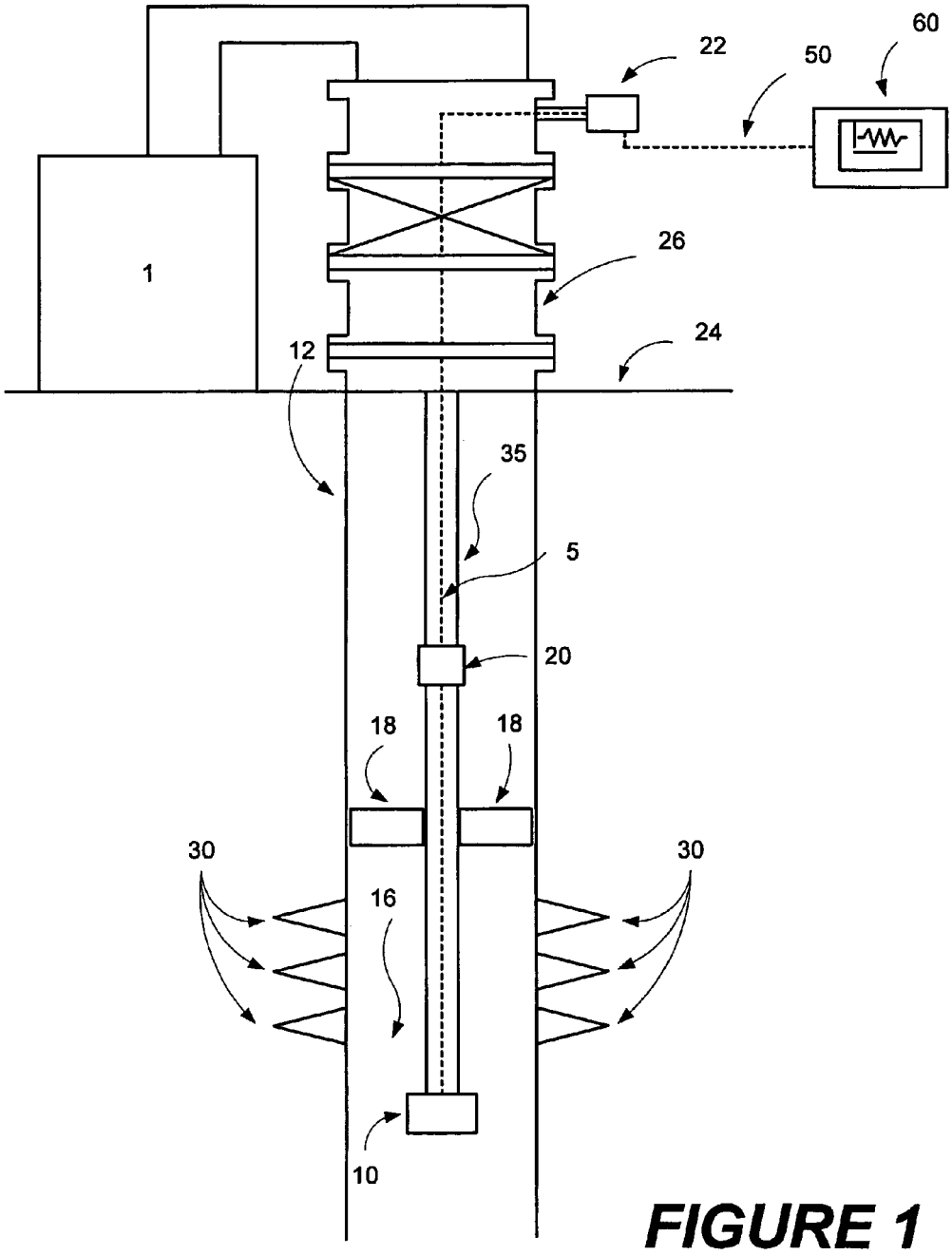
FIG. 1 depicts a side cross-sectional view of a subterranean well bore wherein fluid may be injected, and the results of such injection monitored, according to an exemplary embodiment of the present invention.

While the present invention is susceptible to various modifications and alternative forms, specific exemplary embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DESCRIPTION OF EXEMPLARY EMBODIMENTS

The present invention provides improved methods of monitoring and analyzing the subterranean injection of a fluid, through the use of wavelet analysis of data generated during such subterranean fluid injection. While the methods of the present invention are useful in a variety of subterranean applications, they may be particularly useful in operations including, but not limited to, fracture stimulation, conformance applications, and water- or $CO_2$-flooding. Further, while a number of exemplary embodiments described herein relate to the measurement of pressure in a subterranean formation, it will be understood that any subterranean parameter, including, but not limited to, temperature, may be measured and analyzed in accordance with the methods of the present invention.

FIG. 1 depicts a schematic representation of a subterranean well bore 12 through which a fluid may be injected into a region of the subterranean formation surrounding well bore 12 such that physical property data (e.g., pressure signals, temperature signals, and the like) are generated. The fluid may be of any composition suitable for the particular injection operation to be performed. For example, where the methods of the present invention are used in accordance with a fracture stimulation treatment, a fracturing fluid may be injected into a subterranean formation such that a fracture is created or extended in a region of the formation surrounding well bore 12 and generates pressure signals. The fluid may be injected by injection device 1 (e.g., a pump). Physical property data such as pressure signals may be generated during subterranean injection processes, for reasons including the fact that the injected fluid is being forced into the formation at a high pressure.

The physical property data may be sensed using any suitable technique. For example, sensing may occur downhole with real-time data telemetry to the surface, or by delayed transfer (e.g., by storage of data downhole, followed by subsequent telemetry to the surface or subsequent retrieval of the downhole sensing device, for example). Furthermore, the sensing of the physical property data may be performed at any suitable location, including, but not limited to, the tubing 35 or the surface 24. In general, any sensing technique and equipment suitable for detecting the desired physical property data with adequate sensitivity and/or resolution may be used. FIG. 1 depicts an exemplary embodiment of the present invention wherein the physical property data are sensed by a sensing device 10 resident within well bore 12. The sensing device 10 may be any sensing device suitable for use in a subterranean well bore. An example of a suitable sensing device 10 is a pressure transducer disclosed in commonly owned U.S. patent application Ser. No. 09/538,536, which is hereby incorporated herein for all purposes. In certain exemplary embodiments of the present invention, the sensing device 10 comprises a pressure transducer that is temperature-compensated. In one exemplary embodiment of the present invention, the sensing device 10 is lowered into the well bore 12 and positioned in a downhole environment 16. In certain exemplary embodiments of the present invention, the sensing device 10 may be positioned below perforations 30. In certain exemplary embodiments of the present invention, the downhole environment 16 is sealed off with packing 18, wherein access is controlled with a valve 20.

The physical property data is ultimately transmitted to the surface by transmitter 5 at a desired time after having been sensed by the sensing device 10. As noted above, such transmission may occur immediately after the physical property data is sensed, or the data may be stored and transmitted later. Transmitter 5 may comprise a wired or wireless connection. In one exemplary embodiment of the present invention, the sensing device 10, in conjunction with associated electronics, converts the physical property data to a first electronic signal. The first electronic signal is transmitted through a wired or wireless connection to signal processor unit 22, preferably located above the surface 24 at wellhead 26. In certain exemplary embodiments of the present invention, the signal processor unit 22 may be located within a surface vehicle (not shown) wherein the fracturing operations are controlled. Signal processor unit 22 may perform mathematical operations on a first electronic signal, further described later in this application. In certain exemplary embodiments of the present invention, signal processor unit 22 may be a computer comprising a software program for use in performing mathematical operations. An example of a suitable software program is commercially available from The Math Works, Inc., of Natick, Mass., under the tradename "MATLAB." In certain exemplary embodiments of the present invention, output 50 from signal processor unit 22 may be plotted on display 60.

Figure 2:
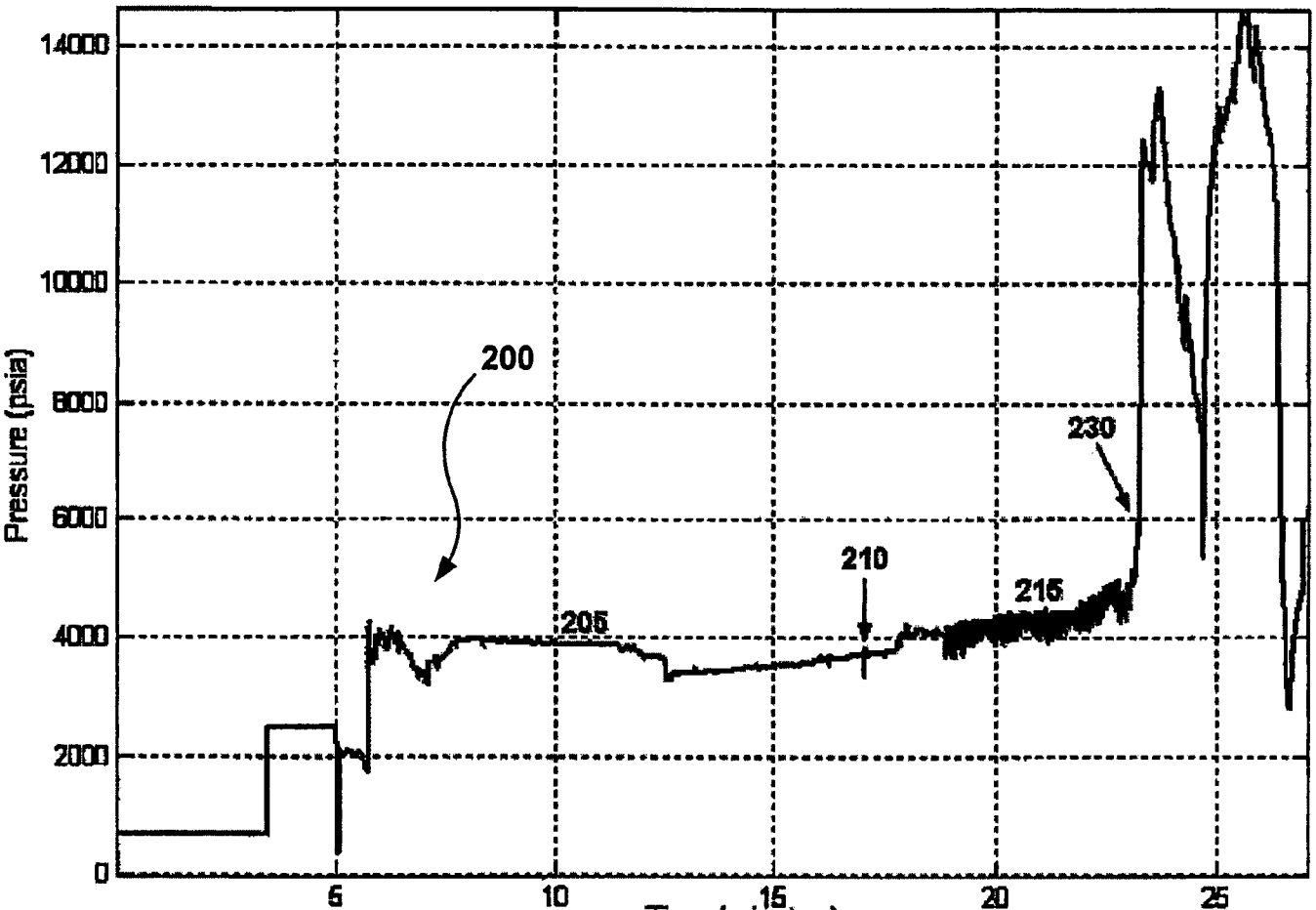
FIG. 2 is a graphical representation of a pressure signal acquired from a subterranean well bore during a fracture stimulation.

Referring now to FIG. 2, a graphical representation of a pressure signal is illustrated and denoted generally by the numeral 200. Pressure signal 200 was acquired from within a subterranean well bore during the injection of a fracturing fluid as part of a fracture stimulation treatment. The well bore is within a near-vertical well that penetrates a sandstone reservoir at almost 5570 feet (True Vertical Depth to top perforation) beneath the surface of the earth. Region 205 refers to the portion of FIG. 2 representing events occurring at a time between 8 and 16 minutes, and illustrates a pressure signal corresponding to normal, continued propagation of a fracture. Region 210 refers to the portion of FIG. 2 representing events occurring at a time between 16 and 18 minutes, and illustrates a pressure signal corresponding to a temporary well bore event, often referred to as a "tool event." Such a temporary well bore event constitutes a "spurious" event for operators, because the event causes a temporary deviation in the parameter being monitored (e.g., pressure), which deviation is entirely unrelated to the condition of the fracturing operation. Region 215 refers to the portion of FIG. 2 representing events occurring at a time between 19 to 23 minutes, and illustrates a pressure signal corresponding to the cessation of fracture propagation (e.g., the moment at which the fracture has stopped extending). Region 230 refers to the portion of FIG. 2 representing events occurring at a time between 23 and 24 minutes, and illustrates a pressure signal corresponding to the closure of the fracture.

In accordance with the present invention, by converting time-based pressure signal 200 to frequency spectrum data using a wavelet transform, such frequency spectrum data may be used to determine at least one parameter relating to the fluid injection. For example, the frequency spectrum data may be used to distinguish a spurious event (e.g., an event whose occurrence within the subterranean formation is entirely unrelated to the fluid injection process) from a formation event (e.g., an event occurring within the subterranean formation, whose occurrence is related to the response of the formation to the fluid injection process). As another example, where the frequency spectrum data are generated in connection with a fracturing operation, the frequency spectrum data may also be used to make other determinations, including, but not limited to, whether a fracture in a subterranean formation is being extended by the injection of a fluid; whether such fracture is effectively not being extended by such injection; whether proppant is backing up in the fracture, and the like. In certain exemplary embodiments of the present invention, such frequency spectrum data (which will be referred to herein as "wavelet coefficient 500") may be generated by performing the wavelet transform on pressure signal 200 in real-time. As used herein, the term "real time" will be understood to mean a time frame in which the occurrence of an event and the reporting or analysis of it are almost simultaneous; e.g., within a maximum duration of not more than two periods of a particular signal being operated upon.

A wavelet transform is a mathematical transform method known in the mathematical and engineering world. Mathematical transforms may be applied to unprocessed time-domain signals (e.g., where the amplitude of the signal is a function of time) in order to extract further information that is not readily available in the raw, unprocessed signal. Performing a mathematical transform on raw, unprocessed data in the time-domain yields the "frequency spectrum" of a signal. The frequency spectrum comprises the frequency components of a signal, e.g., it identifies the particular frequencies that exist within the signal. A wide variety of wavelet transforms may be suitable for use in accordance with the present invention, including but not limited to the Daubechies family of wavelets, biorthogonal pairs of wavelets, and any continuous, homogeneous family of wavelets found to be useful for signal processing.

In general, the wavelet transform of a function F(x) having scale a at a location b may be generated from the following equation:

$$F_{\Psi}(a,b)=\int F(t)\Psi(a,b,t)dt \qquad \text{Equation 1}$$

where Ψ(a,b,t) is characterized by the following equation:

$$\int \Psi(t)dt=0 \qquad \text{Equation 2}$$

Generally speaking, the "scale" of a function relates to the dilation or compression of a portion of a signal at that portion's location within the signal. As frequency is generally inversely proportional to scale, a low scale (e.g., high frequency) may be observed from time to time as short bursts within a signal, whereas a high scale (e.g., low frequency) may in some cases last for the entire duration of the signal. In accordance with the methods of the present invention, the application of a wavelet transform to time-based pressure signal 200 (e.g., F(t) in Equation 1 above) by signal processor unit 22 during the time period in which a fluid is injected into a subterranean formation will generate corresponding wavelet coefficients 500 (e.g., $F_{\Psi}$ in Equation 1 above), which may be normalized and analyzed to determine at least one parameter relating to the fluid injection process. In certain exemplary embodiments of the present invention, wavelet coefficient 500 is normalized by dividing its amplitude at each time increment by an arbitrarily selected value.

An exemplary embodiment of a method of the present invention for the application of wavelet analysis to fluid injection processes is illustrated in the process flow diagram depicted in FIG. 3, and may be performed as follows. In step 301, a fluid is injected into a region of a subterranean formation surrounding a well bore. In step 302, physical property data is sensed in the subterranean formation during the time in which the fluid is injected into the formation. In step 303, a wavelet transform is applied to the physical property data so as to create frequency spectrum data. In certain exemplary embodiments of the present invention, the physical property data is pressure data; in certain other exemplary embodiments of the present invention, the physical property data is a temperature isotherm. In certain exemplary embodiments, the wavelet transform that is applied may be a wavelet from the Daubechies family of wavelets. Step 304 comprises the step of analyzing the frequency spectrum data to determine whether an event (e.g., a formation event or a tool event, for example) has occurred. The occurrence of such event will generally appear as a deviation in the amplitude of normalized wavelet coefficient 500. In certain exemplary embodiments of the present invention, step 304 may further comprise examining the raw pressure signal 200 in conjunction with analyzing the frequency spectrum data. If an event has not occurred, the injection process is proceeding normally. The process proceeds to step 305, wherein the determination is made whether the injection is completed. If the injection is completed (e.g., if the goals of the injection operation have been met), the process ends in step 315. If the injection is not complete, the process returns to step 301.

If, however, the result of the determination in step 304 is that an event has occurred, step 306 comprises analyzing the frequency spectrum data to determine whether the event is a formation event. The occurrence of a formation event may be recognized from an examination of a deviation in normalized wavelet coefficient 500: a deviation caused by the occurrence of a formation event is generally a persistent deviation, comprising numerous data points deviating from the previous trend (an example of which may be seen in FIG. 5, at region 530). In contrast, a spurious event (such as a temporary tool event, for example) may be accompanied by a deviation in the amplitude of normalized wavelet coefficient 500; however the deviation is generally much shorter in duration and may comprise only a few data points (an example of which may be seen in FIG. 5, at region 510). Generally, a spurious event will not be accompanied by a persistent increase in the amplitude of raw pressure signal 200 beyond an initial brief deviation triggered by the occurrence of the spurious event. In certain exemplary embodiments of the present invention, the distinction of a spurious event from a formation event may be made in real time. Indeed, in certain exemplary embodiments of the present invention, all steps in FIG. 3 may be performed in real time. If the analysis in step 306 concludes with a determination that the event is not a formation event, then the event is a spurious event and the process then proceeds to step 307, wherein the determination is made whether the spurious event that has occurred is one that requires the performance of a remediative step. For example, if an instrument (such as sensing device 10, for example) malfunctions, a remediative step may need to be performed to correct the malfunction before the process continues. Similarly, if packing 18 is not properly set, a remediative step may be necessary. One of ordinary skill in the art, with the benefit of this disclosure, will be able to determine whether the spurious event requires the performance of a remediative step. If no remediative step is necessary, the process continues to step 305, wherein the determination is made whether the injection is completed, a determination that has been previously described. If a remediative step is necessary, the process proceeds to step 308, where an appropriate remediative step is performed (e.g., removing the malfunctioning instrument and installing a properly functioning instrument); the process then proceeds to step 305.

If, however, the determination is made in step 306 that the event is a formation event, the process may proceed to step 309, wherein an analysis of the frequency spectrum data is performed to determine the type of formation event that has occurred. A variety of formation events may be identified in step 309 as having occurred, including, but not limited to, the cessation of propagation of a fracture in the formation, the closure of a fracture in the formation, the occurrence of contact between a pressure wave generated by the injection fluid and a boundary within the formation, and any other subterranean event whose occurrence is related to the injection process. The process then proceeds to step 310, wherein a determination is made whether a remediative step, or steps, may be necessary.

The determination of whether a remediative step is necessary will involve a judgement by the operator conducting the injection operation. In certain circumstances, a formation event may occur, but a remediative step may not need to be immediately performed. For example, a formation event comprising an increase in pressure due to a temporary accumulation of proppant in the formation in the near-wellbore area may occur, yet the judgment of the operator may dictate that a remediative step is not necessary until such time as such accumulation of proppant is determined to be undesirable. In certain exemplary embodiments of the present invention, the occurrence of the formation event may not require the immediate performance of a remediative step, but may serve to alert the operator that an adverse situation may be developing, or may be about to develop. One of ordinary skill in the art, with the benefit of this disclosure, will recognize when the performance of a remediative step is necessary. An example of the occurrence of a formation event where the performance of a remediative step is not immediately necessary may be seen in FIG. 5, at region 515, during the time between 19 minutes and 22 minutes; a remediative step was not necessary until about 23.5 minutes, when the cessation of propagation was detected. If a remediative step is determined to be unnecessary, the process proceeds to step 305, wherein the determination is made whether the injection process is complete, as previously described. If, however, a remediative step is determined to be necessary, the process proceeds to step 311, wherein the remediative step is performed. Generally, the remediative step performed in step 311 may be any step, or any series of steps, intended to remedy an adverse condition brought about by the occurrence of the formation event, or to prevent future complications from arising. For example, where the methods of the present invention are performed in conjunction with a conformance application, the remediative step may comprise altering the viscosity of the fluid being injected, or altering the injection pressure. Step 312 comprises an analysis of the frequency spectrum data to determine whether the performance of the remediative step was successful. The determination that a remediative step was successful may be made by identifying whether normalized wavelet coefficient 500 returns to the stable state of very low amplitude disturbances it had occupied before the occurrence of the formation event; an example of a stable state of normalized wavelet coefficient 500 before the occurrence of a formation event may be seen in FIG. 5 at region 505.

If the determination in step 312 concludes that the remediative step was successful, the process is directed to step 305, wherein the determination is made whether the injection process is completed, as has been previously described. If the remediative step or steps are determined to have been unsuccessful, however, the process proceeds to step 313, where a determination is made whether an additional remediative step or steps should be performed. One of ordinary skill in the art, with the benefit of this disclosure, will be able to determine whether an additional remediative step should be performed. If an additional remediative step is necessary, the process returns to step 311, where the additional remediative step is performed, as has been described previously. If the determination made in step 313 is that an additional remediative step is not necessary, the process proceeds to step 314, where a terminal remediative step is performed. Generally, the terminal remediative step performed in step 314 may be any step that is undertaken to remedy or prevent any adverse effects arising out of the injection operation. For example, where the methods of the present invention are used in accordance with a fracturing process, examples of a terminal remediative step include, but are not limited to, discontinuing the injection of the fracturing fluid into the well bore, or halting the injection of a proppant into the well bore, among other possible terminal remediative steps. One of ordinary skill in the art, with the benefit of this disclosure, will recognize the appropriate terminal remediative step for a particular application. The process then proceeds to step 315, wherein the injection process is ended. In certain exemplary embodiments of the present invention, all steps illustrated in FIG. 3 may be performed in real time.

Figure 4:
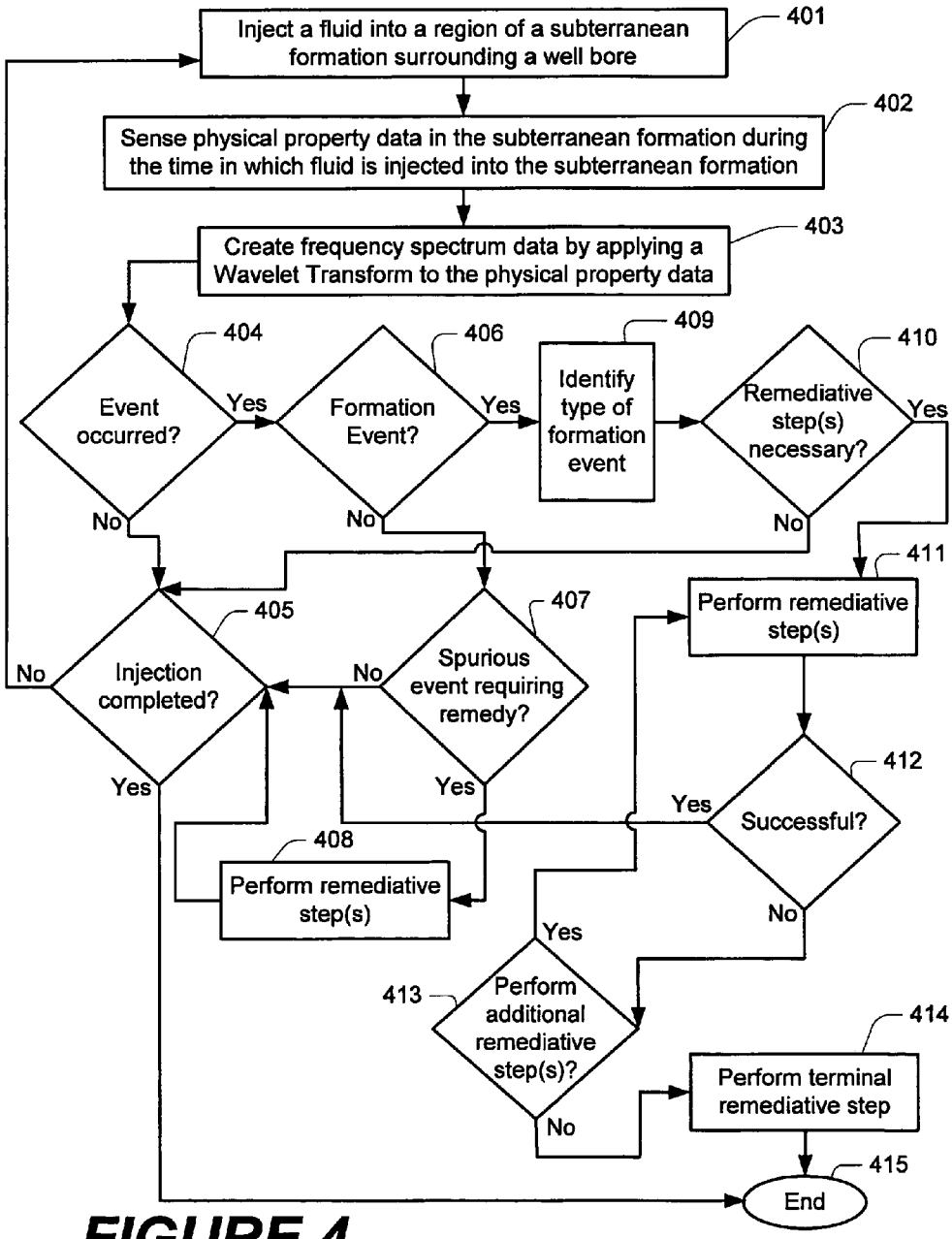
FIG. 4 illustrates a process flow diagram for an exemplary method of the present invention for monitoring the injection of a fluid into a subterranean formation in connection with a fracturing operation.

FIG. 4 depicts an exemplary embodiment where the methods of the present invention are used in connection with a fracturing process. In step 401, a fluid is injected into a region of a subterranean formation surrounding a well bore so as to create or extend at least one fracture in a subterranean formation. In step 402, physical property data is sensed in the subterranean formation during the time in which the fluid is injected into the formation. For example, referring now to FIG. 1, a pressure signal may be received by sensing device 10. In step 403, frequency spectrum data is created by applying a wavelet transform to the physical property data. In certain exemplary embodiments, the wavelet transform that is applied may be a wavelet from the Daubechies family of wavelets. For example, the pressure signal sensed by sensing device 10 may be transmitted to signal processor unit 22, which converts the pressure signal to a normalized wavelet coefficient by applying a wavelet transform to the pressure signal. In certain exemplary embodiments, signal processor unit 22 may produce output 50, comprising normalized wavelet coefficient 500, which may then be generated and plotted on display 60.

Referring again to FIG. 4, in step 404, the frequency spectrum data is analyzed to determine whether an event (e.g., a formation event or a tool event) has occurred. The occurrence of such event will generally appear as a deviation in the amplitude of normalized wavelet coefficient 500. In certain exemplary embodiments of the present invention, step 404 may further comprise examining the raw pressure signal 200 in conjunction with analyzing the frequency spectrum data. If an event has not occurred, then the injection process is proceeding normally (e.g., the fracture is being extended by the injection of the fluid), and the process proceeds to step 405, where the determination is made whether the injection process is complete. If the injection process is determined to be complete, the process proceeds to step 415, where it ends. If the injection process is not complete, the process returns to step 401. If, however, the result of the determination in step 404 is that an event has occurred, the process proceeds to step 406, which comprises analyzing the frequency spectrum data to determine whether the event is a formation event, a determination that has been previously described with reference to FIG. 3. If the event that has occurred is found not to be a formation event, the event is a spurious event and the process proceeds to the determination in step 407 of whether the spurious event requires a remedy, which determination has been previously described with reference to FIG. 3. If the spurious event is determined not to require a remedy, the process continues to the determination in step 405, which has been previously described. If the spurious event is determined to require a remedy, the process continues to step 408, where a remediative step or steps tailored to the particular spurious event are performed, after which the process continues to the determination in step 405 of whether the injection process is complete, which determination has been previously described.

If, however, the determination is made in step 406 that a formation event has occurred, the process proceeds to step 409, where the type of formation event is identified. For example, the formation event may be identified as the planned or unplanned cessation of propagation of the fracture, the closure of the fracture, the propagation of the fracture into an undesirable zone of the formation, or a wide variety of other events. The cessation of propagation of the fracture may be recognized from an examination of a deviation in the amplitude of normalized wavelet coefficient 500: a deviation caused by the cessation of propagation of the fracture generally demonstrates a persistently higher amplitude than had been observed before the occurrence of the event (an example of a deviation caused by the cessation of propagation may be seen in FIG. 5, at region 515), and is often accompanied by an increase in the amplitude of raw pressure signal 200. Fracture closure may be recognized from an examination of a deviation in the amplitude of normalized wavelet coefficient 500 versus time: a deviation caused by fracture closure generally comprises peaks having a far greater amplitude than peaks generated by the cessation of propagation. In certain exemplary embodiments of the present invention, the identification of the type of formation event made in Step 409 further comprises using conventional monitoring techniques in conjunction with analyzing frequency spectrum data, e.g., by analyzing normalized wavelet coefficient 500 along with analyzing a conventional log-log plot of a net pressure curve. For example, an operator may detect the cessation of propagation of the fracture through an analysis of normalized wavelet coefficient 500, and utilize a log-log plot of a net pressure curve to confirm the initial identification of the formation event. After the identification in step 409 of the type of formation event that has occurred, the process proceeds to step 410, where the determination is made whether a remediative step is necessary. This determination has been previously described with reference to FIG. 3. If a remediative step is found to be unnecessary, the process proceeds to the determination in step 405 of whether the injection is completed, which determination has previously been described.

If, however, a remediative step is found to be necessary, the process proceeds to step 411, wherein the remediative step is performed. For example, the remediative step may comprise: discontinuing the injection of the fluid into the well bore; injecting a different fluid into the well bore; or pressure pulsing the injection of the fluid into the well bore. In certain other embodiments, the remediative step may comprise halting the injection of a proppant into the well bore; injecting a different proppant into the well bore; or injecting a clear fluid into the well bore, then resuming the injection of proppant into the well bore. One of ordinary skill in the art, with the benefit of this disclosure, will be able to recognize an appropriate remediative step for a particular formation event. The preceding recitation of possible remediative steps is not meant to comprise an exhaustive list of remediative steps, but is intended merely for illustrative purposes. Other embodiments of remediative steps are encompassed within the present invention, and will be recognizable to one of ordinary skill in the art, with the benefit of this disclosure. After the remediative step is performed in step 411, the process moves to step 412, which comprises a determination of whether the remediative step was successful (e.g., whether the fracture has resumed extending). Such a determination may be made from an examination of normalized wavelet coefficient 500, to identify whether it has resumed its previous, stable trend (corresponding to normal fracture propagation) demonstrated prior to the formation event; an example of such stable trend prior to a formation event may be seen in FIG. 5, at region 505. If it is determined in step 412 that the fracture has resumed extending, then the process returns to step 405, wherein the determination is made whether the injection process is complete, as previously described. If it is determined in step 412 that the fracture has not resumed extending, the process proceeds to step 413, where a determination is made whether an additional remediative step or steps should be performed; such determination has been previously described with reference to FIG. 3. If the determination in step 413 is that an additional remediative step or steps should be performed, the process returns to step 411, which has been previously described. If, however, the determination in step 413 is that an additional remediative step should not be performed, the process continues to step 414, wherein a terminal remediative step is performed. For example, the terminal remediative step may comprise: discontinuing the injection of the fluid into the well bore; injecting a different fluid into the well bore; halting the injection of a proppant into the well bore; or another suitable terminal remediative step. The preceding recitation of possible terminal remediative steps is not meant to comprise an exhaustive list of terminal remediative steps, but is intended merely for illustrative purposes. Other embodiments of terminal remediative steps are encompassed within the present invention, and will be recognizable to one of ordinary skill in the art, with the benefit of this disclosure. After the terminal remediative step is performed in step 414, the process terminates in step 415. In certain exemplary embodiments of the present invention, all steps illustrated in FIG. 4 may be performed in real time.

Figure 3:
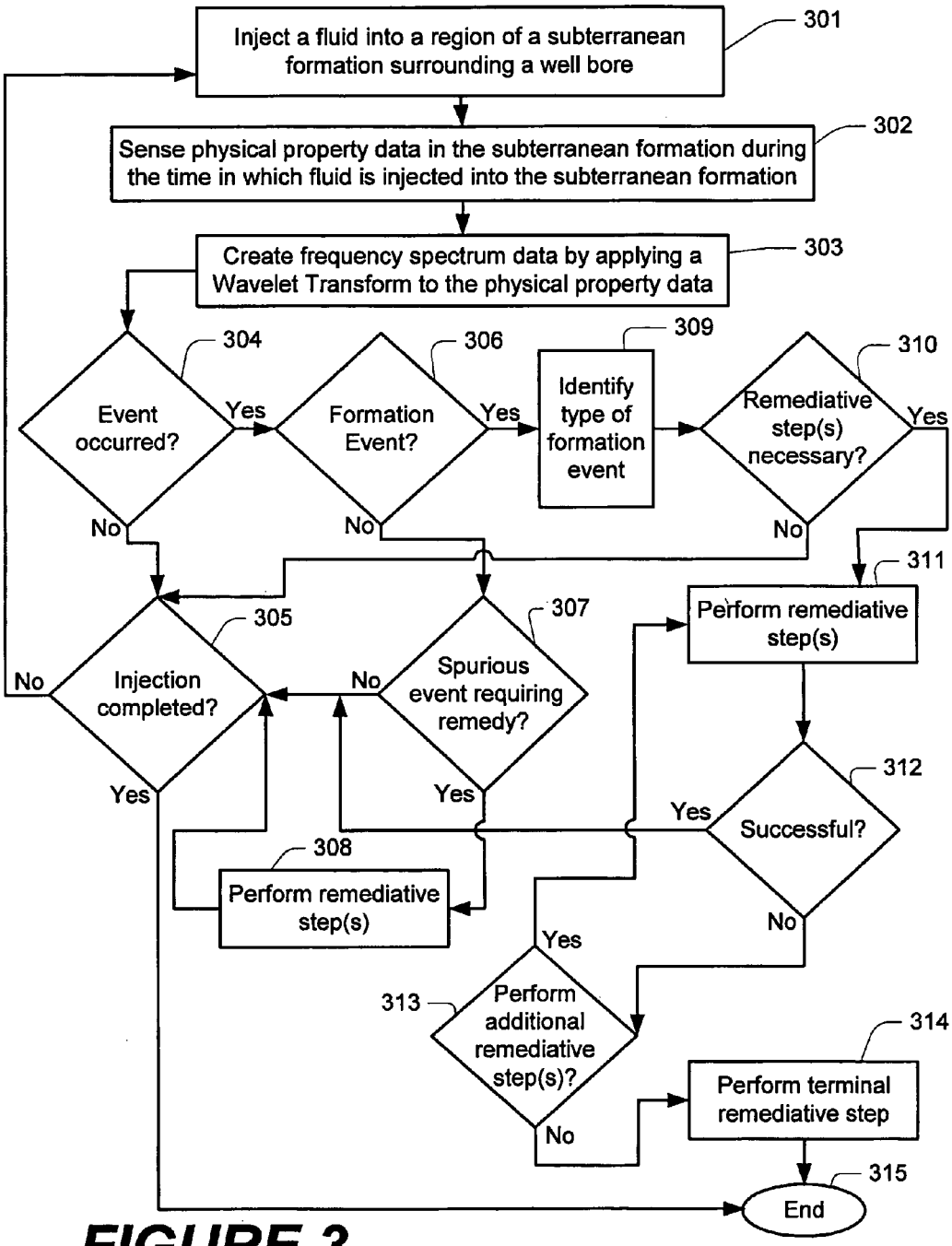
FIG. 3 illustrates a process flow diagram for an exemplary method of the present invention for monitoring the injection of a fluid into a subterranean formation.
Figure 5:
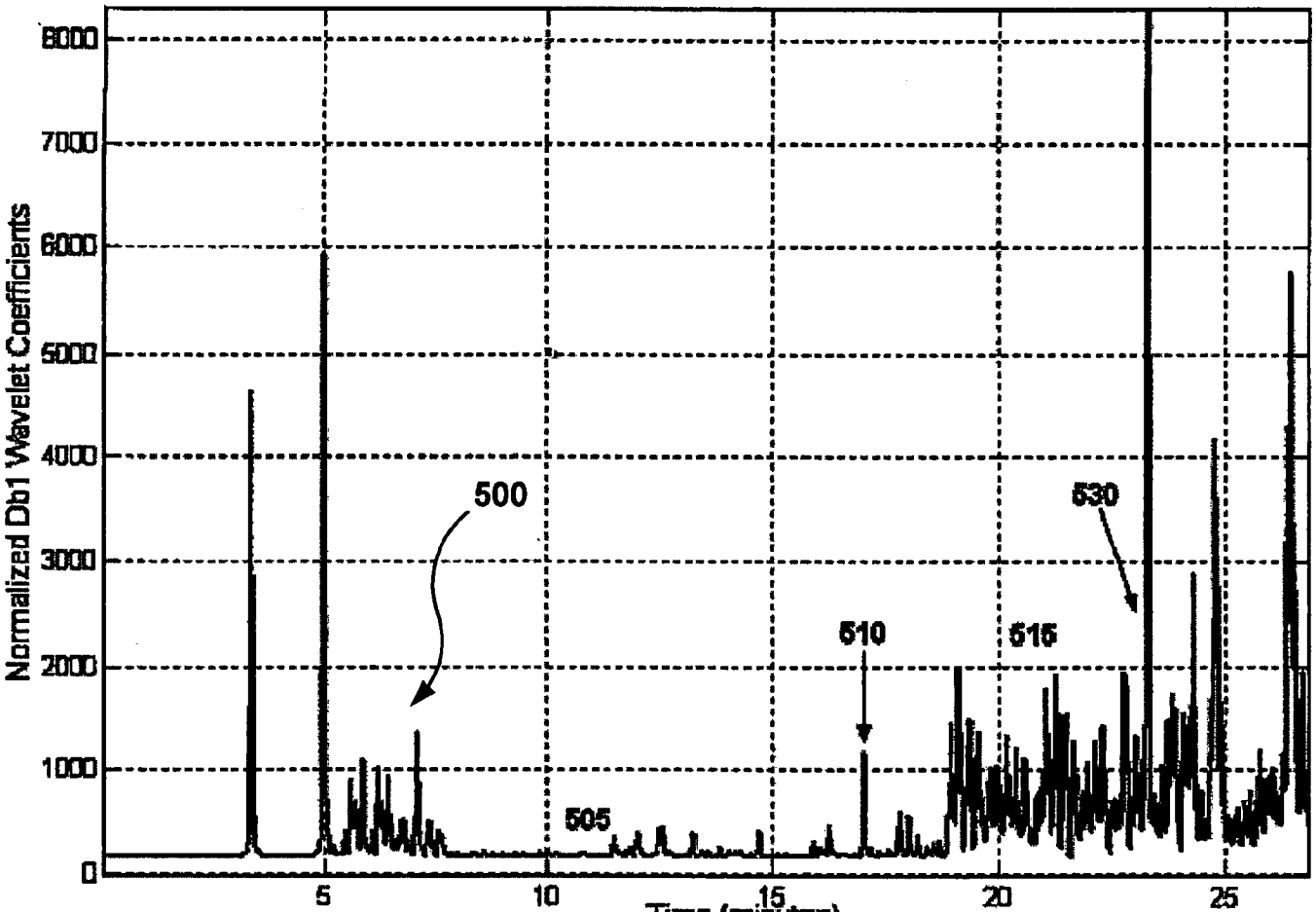
FIG. 5 is a graphical representation of a normalized wavelet coefficient generated by the application of a Wavelet Transform to a pressure signal acquired from a subterranean formation during a fracture stimulation according to the present invention.

Whereas FIGS. 3 and 4 illustrated exemplary embodiments of methods of the present invention comprising steps involving the generation and analysis of a normalized wavelet coefficient, FIG. 5 depicts a graphical representation of an embodiment of normalized wavelet coefficient 500 generated from a subterranean well bore during an actual fracture stimulation treatment. Regions 505, 510, 515, and 530 of FIG. 5 illustrate regions of normalized wavelet coefficient 500 generated in accordance with the present invention and correspond contemporaneously to regions 205, 210, 215, and 230, respectively, of FIG. 2. An examination of FIG. 5 illustrates that the methods of the present invention facilitate the distinction of normal fracture propagation from the cessation of propagation; as shown in FIG. 5, a region of normal fracture propagation illustrated by region 505 may be easily distinguished from region 515, wherein the fracture has stopped propagating. In certain exemplary embodiments of the present invention, the distinction between normal fracture propagation and the cessation of propagation may be made in real-time. The indication of the cessation of propagation of the subterranean fracture by region 515 of normalized wavelet coefficient 500 may spur an operator to take a variety of remediative steps, including but not limited to those previously described herein. In certain exemplary embodiments of the present invention, the remediative step may be taken before the fracture closes. FIG. 5 also illustrates that the methods of the present invention also facilitate the distinction of spurious data (such as a temporary tool event) from a formation event, (e.g., actual fracture closure) as may be seen from a comparison of region 510 to region 530. Where a normalized wavelet coefficient is generated by the application of a wavelet transform to a set of physical property data, a deviation in such normalized wavelet coefficient caused by the occurrence of a formation event is generally a persistent deviation, comprising numerous data points deviating from the previous trend, as may be seen from region 515. In contrast, a deviation due to the occurrence of a spurious event (such as a temporary tool event) is generally much shorter in duration, and may comprise only a few data points, as may be seen from region 510. The methods of the present invention permit the distinction between a spurious event and a formation event to be made far more rapidly than would be permitted by conventional fracturing monitoring techniques because the normalized wavelet coefficients generated by the methods of the present invention are plotted and analyzed in real time, as opposed to being plotted on a log-log plot as is the case with conventional techniques. In certain embodiments of the present invention, the distinction between spurious data and a formation event may be made by an operator in real-time. Where a tool event occurs, the rapid distinction between a tool event and a formation event may permit an operator to continue fracturing operations rather than halt fracturing prematurely. Where a formation event (e.g., fracture closure) occurs, the rapid distinction between a tool event and a formation event may permit an operator to promptly undertake a remediative step, such as to reduce, or eliminate, proppant accumulation in the well bore. In certain exemplary embodiments, the remediative step may be undertaken in real time.

Figure 6:
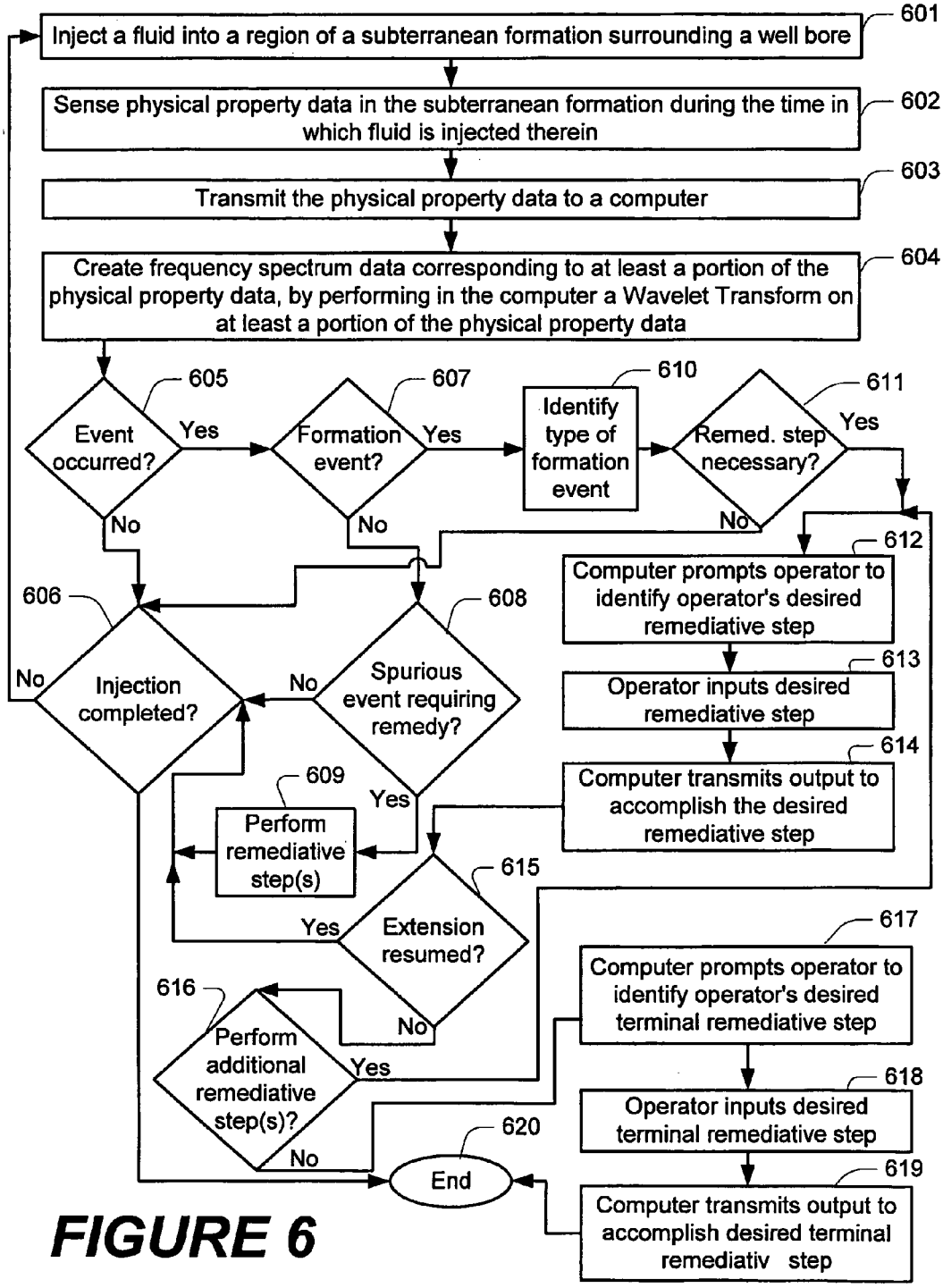
FIG. 6 illustrates a process flow diagram for an exemplary method of the present invention for computer-implemented monitoring of the injection of a fluid into a subterranean formation.

In certain exemplary embodiments of the present invention, signal processor unit 22 may be a computer comprising an expert software program, wherein the expert software program is programmed (in software or firmware) using known programming techniques to analyze normalized wavelet coefficient 500 and identify events such as tool events, formation events, fracture closure, and the like, and to display a message on a computer screen suggesting to the operator the occurrence of such event. The computer may further provide an output signal used to control the overall fluid injection process, such as controlling the pumping of the fracturing fluid or the formulating of the fracturing fluid, for example. The computer may comprise software programmed (in software or firmware) using known programming techniques to implement the desired functions of the present invention as described herein. Accordingly, FIG. 6 depicts an exemplary embodiment wherein the methods of the present invention are used in connection with a computer-implemented method for monitoring the injection of fluid into a subterranean formation. The exemplary embodiment illustrated in FIG. 6 is described with reference to a fracturing operation, but it is contemplated and within the scope of the present invention for the invention described herein to be applied to other injection operations (e.g., conformance applications and flooding operations, among others) with some modification. In step 601, a fluid is injected into a region of a subterranean formation surrounding a well bore. In step 602, physical property data (e.g., pressure data, temperature data and the like) is sensed in the subterranean formation during the time in which the fluid is injected therein. In step 603, the physical property data is transmitted to a computer (e.g., signal processor unit 22). In step 604, the computer performs a Wavelet Transform on at least a portion of the physical property data so as to provide frequency spectrum data (e.g., normalized wavelet coefficient 500) corresponding to at least a portion of the physical property data.

In step 605, the computer analyzes the frequency spectrum data to determine whether an event has occurred. The occurrence of such event will generally appear as a deviation in the amplitude of normalized wavelet coefficient 500. If the answer to the determination in step 605 is no, then the injection process is proceeding effectively, and the process proceeds to the determination in step 606 of whether the injection process is complete, a determination that has been previously described. If the injection process is determined not to be complete, the process returns to step 601. If the injection process is determined to be complete, the process proceeds to end in step 620. However, it will be recognized that in certain exemplary embodiments, an operator may elect to perform a terminal remediative step before ending the injection process, and thus in such embodiments the computer may be programmed to proceed from step 606 to step 617, wherein the operator is prompted to identify a desired terminal remediative step; step 617 will be further described later in this application.

If, however, the answer to the determination in step 605 is that an event has occurred, the process proceeds to step 607. Step 607 comprises analyzing the frequency spectrum data to determine whether the event is a formation event, which determination has previously been described with reference to FIG. 3. In certain exemplary embodiments of the present invention, the determination made in step 607 further comprises using conventional monitoring techniques in conjunction with analyzing frequency spectrum data, e.g., by analyzing normalized wavelet coefficient 500 along with analyzing a conventional log-log plot of a net pressure curve. For example, an operator may detect a formation event such as the cessation of propagation through an analysis of normalized wavelet coefficient 500, and wait for confirmation of the formation event on the log-log plot of a net pressure curve before acting on such detection. If the analysis in step 607 concludes with a determination that the event is not a formation event, the event is therefore a spurious event, and the process proceeds to step 608, wherein the determination is made whether the spurious event that has occurred is one that requires the performance of a remediative step, as has been previously described with reference to FIG. 3. If the spurious event is determined not to require a remedy, the process continues to the determination in step 606 of whether the injection is complete, which has been previously described. If, however, the determination is made in step 608 that the spurious event does require a remedy, then the process continues to step 609, where a remediative step or steps tailored to the particular spurious event are performed, after which the process continues to the determination in step 606 of whether the injection process is complete, which determination has been previously described.

If, however, the analysis in step 607 concludes with a determination that the event is a formation event, the process proceeds to step 610 wherein the type of formation event is identified, which step has previously been described with reference to FIG. 4. From step 610, the process proceeds to step 611, wherein a determination is made of whether a remediative step is necessary. If a remediative step is determined to be unnecessary, the process proceeds to step 606, which has been previously described. If, however, a remediative step is determined to be necessary, the process proceeds to step 612, wherein the computer prompts the operator to identify the operator's desired remediative step. Such remediative step may comprise those previously described herein, for example. Other embodiments of remediative steps are encompassed within the present invention, and will be recognizable to one of ordinary skill in the art, with the benefit of this disclosure. In step 613, the operator informs the computer of the desired remediative step. In step 614, the computer transmits an output to perform the desired remediative step.

From step 614, the process proceeds to step 615, wherein the frequency spectrum data (generated after the remediative step is performed) is analyzed to determine whether the remediative step was successful (e.g., whether the fracture resumed extending after the performance of the remediative step). Such a determination may be made from an examination of normalized wavelet coefficient 500, to identify whether it has resumed its previous, stable trend (corresponding to normal fracture propagation) demonstrated prior to the formation event; an example of such stable trend prior to a formation event may be seen in FIG. 5, at region 505. If it is determined in step 615 that the remediative step was successful, then the process returns to step 606, which has been previously described. If it is determined in step 615 that the remediative step was not successful, the process proceeds to step 616.

In step 616, a determination is made whether an additional remediative step or steps should be performed; such determination has been previously described with reference to FIG. 3. If the determination in step 616 is that an additional remediative step or steps should be performed, the process returns to step 612, which has been previously described. If, however, the determination in step 616 is that an additional remediative step should not be performed, the process continues to step 617, where the computer prompts the operator to identify the operator's desired terminal remediative step. In step 618, the operator identifies the desired terminal remediative step for the computer, and in step 619 the computer transmits an output to accomplish the desired terminal remediative step. The terminal remediative step may comprise steps such as those described above, for example. Other embodiments of terminal remediative steps are encompassed within the present invention, and will be recognizable to one of ordinary skill in the art, with the benefit of this disclosure. After the terminal remediative step is performed in step 619, the process terminates in step 620. In certain exemplary embodiments of the present invention, all steps illustrated in FIG. 6 may be performed in real time.

Figure 7A:
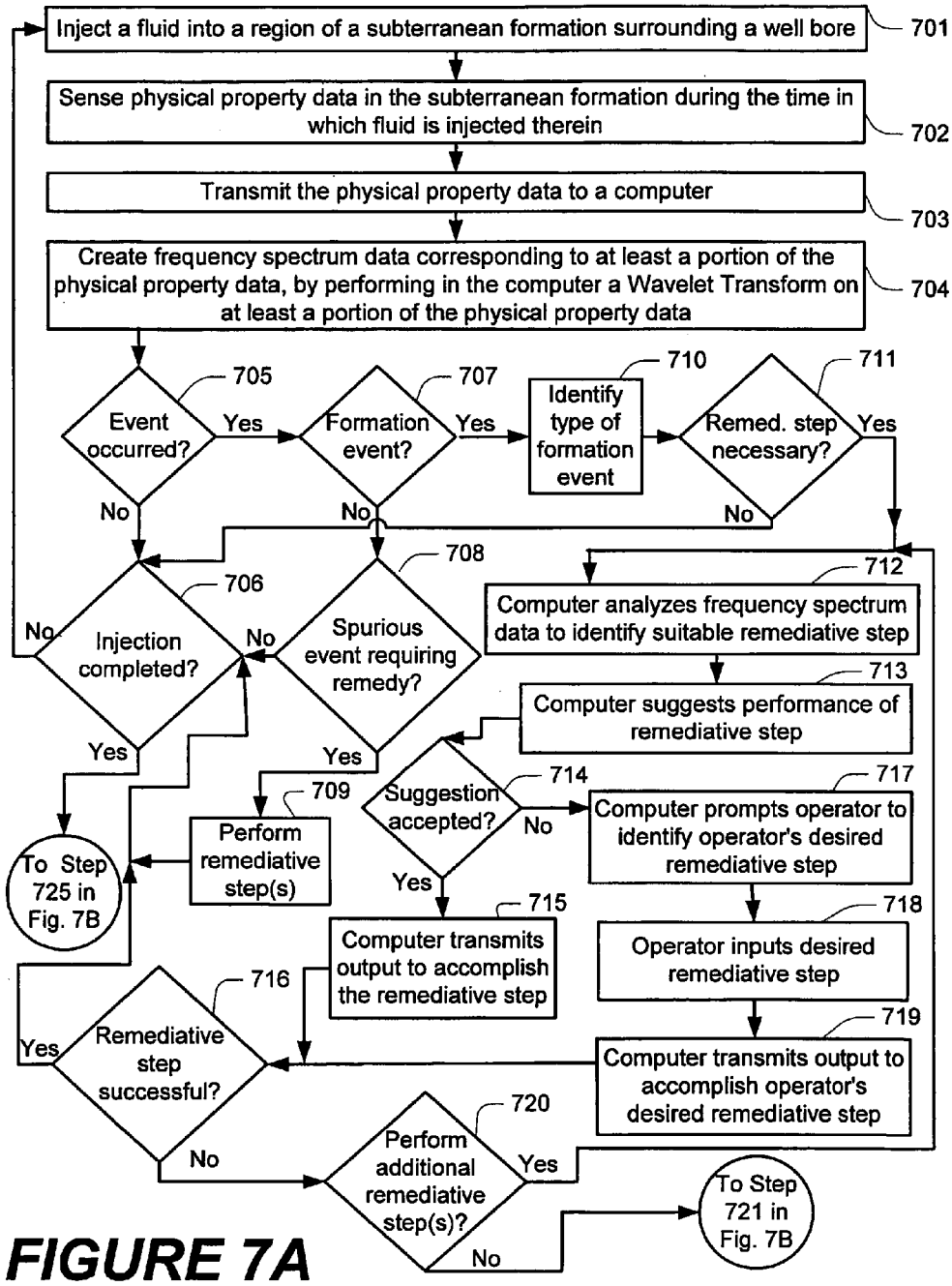
FIGS. 7A and 7B illustrate a process flow diagram for another exemplary method of the present invention for computer-implemented monitoring of the injection of a fluid into a subterranean formation.
Figure 7B:
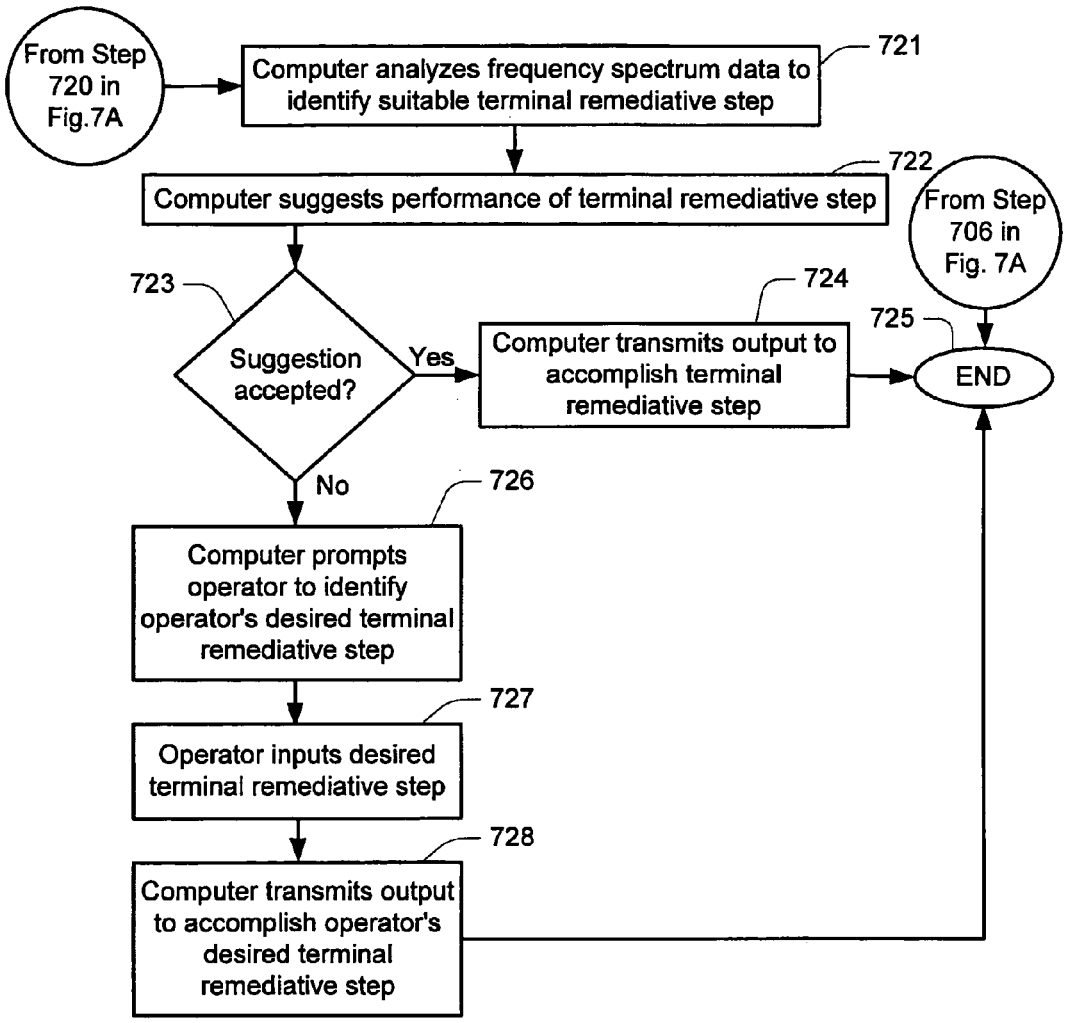

Referring now to FIGS. 7*a* and 7*b*, a process flow diagram of another exemplary embodiment of a computer-implemented method for monitoring the injection of fluid into a subterranean formation is illustrated therein. Steps 701 through 711 are comparable to steps 601 through 611 illustrated in, and previously described with reference to, FIG. 6. In certain exemplary embodiments of the present invention where the computer (e.g., signal processor unit 22) comprises an expert software program, step 712 may comprise the computer analyzing the frequency spectrum data to identify a suitable remediative step. The process then proceeds to step 713, wherein the computer suggests the performance of the particular remediative step identified in step 712. Such "suggestion" of a remediative step may occur, for example, by displaying a message on display 60, suggesting that the operator perform a particular remediative step. From step 713, the process continues to step 714, wherein the operator enters an input to authorize, or reject, the computer's suggested remediative step. If the operator authorizes the suggested remediative step in step 714, the process proceeds to step 715, wherein the computer transmits an output to accomplish the desired remediative step, after which the process continues to step 716. If, however, the operator rejects the computer's suggested remediative step in step 714, the process proceeds to step 717, wherein the computer prompts the operator to enter an input identifying the operator's desired remediative step. The process then continues to step 718, wherein the operator inputs the desired remediative step. From there, the process proceeds to step 719, wherein the computer transmits an output to accomplish the operator's desired remediative step. The process then proceeds to step 716, which comprises analyzing the frequency spectrum data (generated after the remediative step is performed) to determine whether the remediative step was successful (e.g., whether the fracture resumed extending after the performance of the remediative step). Such a determination may be made from an examination of normalized wavelet coefficient 500, to identify whether it has resumed its previous, stable trend (corresponding to normal fracture propagation) demonstrated prior to the formation event; an example of such stable trend prior to a formation event may be seen in FIG. 5, at region 505. If it is determined in step 716 that the remediative step was successful, then the process returns to step 706, which has been previously described with reference to FIG. 6. If, however, it is determined in step 716 that the remediative step was not successful, the process proceeds to step 720.

In step 720, a determination is made whether an additional remediative step or steps should be performed; such determination has been previously described with reference to FIG. 3. If the determination in step 720 is that an additional remediative step or steps should be performed, the process returns to step 712, which has been previously described. If, however, the determination in step 720 is that an additional remediative step should not be performed, the process continues to step 721, where the computer analyzes the frequency spectrum data to identify a suitable terminal remediative step. The process then proceeds to step 722, wherein the computer suggests the performance of the particular terminal remediative step identified in step 721. From step 722, the process continues to step 723, wherein the operator enters an input to authorize, or reject, the computer's suggested terminal remediative step. If the operator authorizes the suggested terminal remediative step in step 723, the process proceeds to step 724, wherein the computer transmits an output to accomplish the desired terminal remediative step, after which the process proceeds to step 725, where it ends.

If, however, the operator rejects the computer's suggested remediative step in step 723, the process proceeds to step 726, wherein the computer prompts the operator to enter an input identifying the operator's desired terminal remediative step. The process then continues to step 727, wherein the operator inputs the desired terminal remediative step. From there, the process proceeds to step 728, wherein the computer transmits an output to accomplish the operator's desired terminal remediative step. The process then proceeds to step 725, where it ends. In certain exemplary embodiments of the present invention, all steps illustrated in FIGS. 7*a* and 7*b* may be performed in real time.

Figure 8:
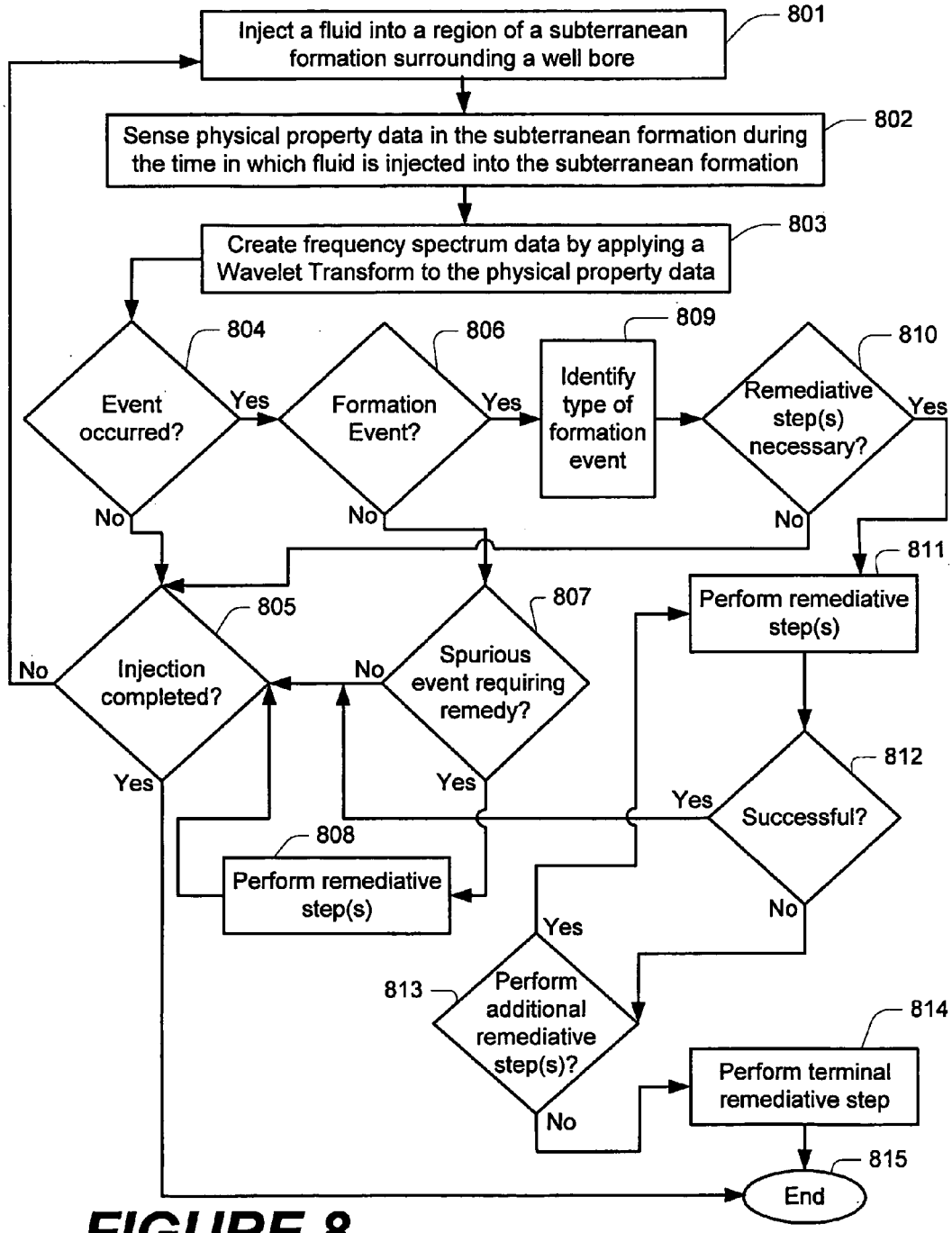
FIG. 8 illustrates a process flow diagram for an exemplary method of the present invention for monitoring the injection of a fluid into a subterranean formation in connection with a conformance application.

While the present invention has been primarily described herein with reference to fracturing operations, it will be understood that the methods of the present invention may also be suitable for any other subterranean application comprising the step of injecting a fluid into a region of a subterranean formation surrounding a well bore. For example, the methods of the present invention may prove useful in conformance applications, as illustrated by the exemplary embodiment depicted in FIG. 8. In step 801, a fluid is injected into a region of a subterranean formation surrounding a well bore so as to alter the flow profile of a second fluid within the subterranean formation. In step 802, physical property data is sensed in the subterranean formation during the time in which the fluid is injected into the formation. In step 803, frequency spectrum data is created by applying a Wavelet Transform to the physical property data. In step 804, the frequency spectrum data is analyzed to determine if an event has occurred, which determination has already been described with reference to FIG. 3. If the answer to the determination in step 804 is no, then the process may proceed to step 805, wherein the determination is made whether the injection is completed (e.g., whether the goals of the injection have been met). If the injection is completed, the process continues to step 815, where it ends. If the injection is not completed at step 805, the process returns to step 801.

Returning to the determination made in step 804, if the answer to the determination therein is that an event has occurred, the process continues to step 806, where the frequency spectrum data is analyzed to determine whether the event is a formation event, as previously described herein. If the determination in step 806 is that a formation event has not occurred, the event is a spurious event, and the process passes to the determination in step 807 of whether the spurious event requires a remedy, which determination has been previously described with respect to FIG. 3. If the spurious event is determined to require a remedy, the process continues to step 808, wherein a remediative step or steps tailored to the particular spurious event are performed, after which the process continues to the determination in step 805 of whether the injection has been completed, which determination has already been described.

If, however, the determination in step 806 is that a formation event has occurred, the process continues to step 809, which comprises analyzing the frequency spectrum data to identify the particular formation event that has occurred. For example, the formation event may comprise the obstruction of the injection fluid by a subterranean boundary. The presence of a subterranean boundary may be recognized from an examination of a deviation in the amplitude of normalized wavelet coefficient 500: a deviation caused by contact with a subterranean boundary is generally accompanied by a significant, persistent deviation in the amplitude of normalized wavelet coefficient 500. Generally, such deviation in the amplitude of normalized wavelet coefficient will persist for more than 1 minute before the amplitude returns to the level it occupied before the event. In certain exemplary embodiments, such deviation in the amplitude of normalized wavelet coefficient will persist for several minutes before the amplitude returns to the level it occupied before the contact with the subterranean boundary occurred. Another example of a formation event may occur when the injected fluid is determined to have flowed out of the zone of interest and entered a different, second zone within the subterranean formation that has a diffusivity different from that of the zone of interest. The departure of the injection fluid from the zone of interest may be detected from an examination of a deviation in the amplitude of normalized wavelet coefficient 500, which will either increase or decrease, depending on factors such as the permeability of the second zone and the viscosity of the injection fluid. The deviation in the amplitude of normalized wavelet coefficient 500 caused by departure of the injection fluid from the zone of interest will persist for a time duration that is longer than that of a spurious event but shorter than that which occurs from contact with a boundary. The preceding recitation of formation events is not meant to comprise an exhaustive list of formation events, but is intended merely for illustrative purposes. Other embodiments of formation events are encompassed within the present invention, and will be recognizable to one of ordinary skill in the art, with the benefit of this disclosure.

After the identification in step 809 of the type of formation event that has occurred, the process continues to step 810, where a determination is made whether a remediative step is necessary. As previously described with reference to FIG. 3, the determination whether a remediative step is necessary will involve the judgment of the operator. In certain exemplary embodiments of the present invention, the occurrence of the formation event may not require the immediate performance of a remediative step, but may serve to alert the operator that an adverse situation may be developing, or may be about to develop. One of ordinary skill in the art, with the benefit of this disclosure, will recognize when the performance of a remediative step is necessary. If it is determined in step 810 that a remediative step is not necessary, the process continues to step 805, which has been previously described. If, however, it is determined in step 810 that a remediative step is necessary, the process continues to step 811, wherein the remediative step is performed. For example, the remediative step may comprise reducing the fluid injection pressure, in some embodiments. Where the fluid injection is determined to have exited the zone of interest in the formation, the remediative step may comprise proceeding to terminate the injection. In certain exemplary embodiments involving dual injection operations, the remediative step may comprise altering the injection rates for the two fluids, or altering the ratio of the injection rates. After the performance of the remediative step in step 811, the process passes to step 812, comprising the examination of the frequency spectrum data generated after the performance of the remediative step, to determine if the remediative step was successful. Success will generally be determined by evaluating whether normalized wavelet coefficient 500 has returned to its stable state demonstrated before the injected fluid encountered the subterranean boundary. If the remediative step is determined to have been successful, the process passes to step 805 for a determination of whether injection is completed. If, however, the remediative step has proven unsuccessful, the process proceeds to step 813, where a determination is made whether an additional remediative step or steps should be performed; such determination has been previously described with reference to FIG. 3. If the determination in step 813 is that an additional remediative step or steps should be performed, the process returns to step 811, which has been previously described. If, however, the determination in step 813 is that an additional remediative step should not be performed, the process continues to step 814, wherein a terminal remediative step is performed. Such terminal remediative step may comprise, for example, discontinuing the injection of a particular fluid. The process then ends in step 815. In certain exemplary embodiments of the present invention, all steps in FIG. 8 may be performed in real time.

Figure 9:
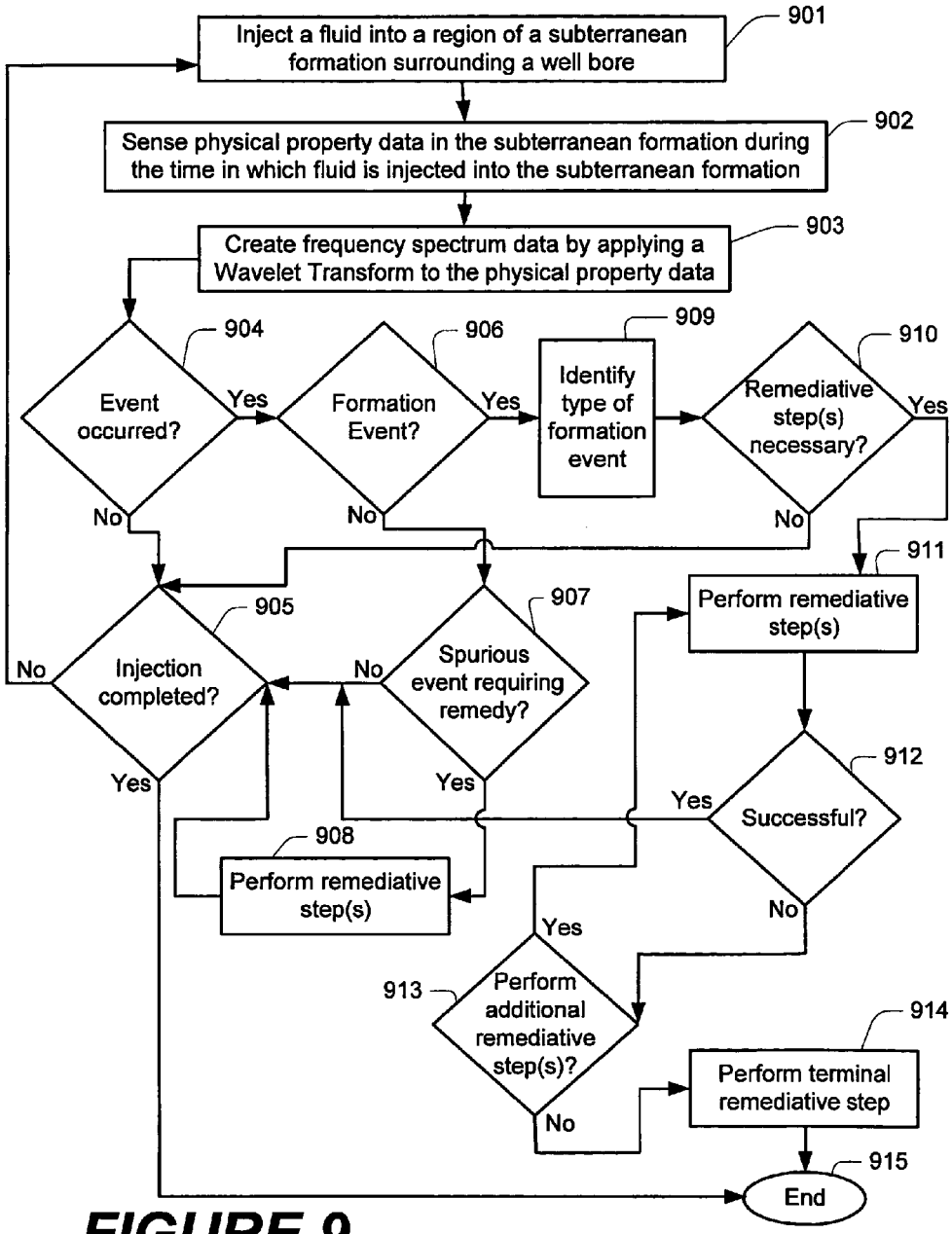
FIG. 9 illustrates a process flow diagram for an exemplary method of the present invention for monitoring the injection of a fluid into a subterranean formation in connection with a water-flooding or $CO_2$-flooding operation.

Another instance where the methods of the present invention may also be used involves $CO_2$-flooding or water-flooding operations, wherein carbon dioxide or water are injected in order to maintain or increase the pressure in the subterranean formation, as illustrated by the exemplary embodiment depicted in FIG. 9. Flooding applications may be of lengthy duration (e.g., days, months, or years). The steps illustrated in FIG. 9 are comparable to those illustrated in, and previously described with reference to, FIG. 8. The remediative step performed in step 911 may comprise altering the viscosity of the injected fluid, for example where the permeability within the subterranean formation is found to possess substantial heterogeneity. In other exemplary embodiments, the remediative step may comprise altering the rate at which the fluid is injected. In certain exemplary embodiments of the present invention, all steps in FIG. 9 may be performed in real time.

Therefore, the present invention is well-adapted to carry out the objects and attain the ends and advantages mentioned as well as those which are inherent therein. While the invention has been depicted, described, and is defined by reference to exemplary embodiments of the invention, such a reference does not imply a limitation on the invention, and no such limitation is to be inferred. The invention is capable of considerable modification, alternation, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects.

We claim:

1. A method for monitoring the injection of fluid into a subterranean formation, comprising the steps of:

injecting a fluid into a region of the subterranean formation surrounding a well bore;

creating frequency spectrum data by applying a wavelet transform to physical property data sensed in the subterranean formation during the time in which fluid is injected into the formation; and determining from the frequency spectrum data at least one parameter relating to the fluid injection.

2. The method of claim 1 wherein the physical property data is selected from the group consisting of pressure data and temperature data.

3. The method of claim 1 wherein all steps are performed in real time.

4. The method of claim 1 further comprising performing a remediative step.

5. The method of claim 4 wherein the remediative step is selected from the group consisting of discontinuing the injection of the fluid into the well bore; injecting a different fluid into the well bore; pressure pulsing the injection of the fluid into the well bore; halting the injection of a proppant into the well bore; injecting a different proppant into the well bore; injecting a clear fluid into the well bore, then resuming the injection of proppant into the well bore; reducing the injection pressure of the fluid injected into the formation; and altering the viscosity of the fluid injected into the formation.

6. The method of claim 1 wherein the step of injecting a fluid comprises injecting a fluid into a region of the subterranean formation surrounding a well bore so as to create or extend at least one fracture in a subterranean formation.

7. The method of claim 6 wherein the step of determining at least one parameter comprises making a determination selected from the group consisting of: determining that the fracture is being extended by the injection of the fluid; determining that a spurious event has occurred; determining that a formation event has occurred; determining the type of formation event that has occurred; determining whether a remediative step is necessary; and determining whether a remediative step that has been performed was successful.

8. The method of claim 6 wherein the step of determining at least one parameter comprises determining that a formation event has occurred, comprising making a determination selected from the group consisting of: determining that the fracture has ceased to extend and determining that the fracture has closed.

9. The method of claim 7 wherein the step of determining at least one parameter further comprises the step of utilizing a log-log plot of a net pressure curve.

10. The method of claim 7 further comprising the additional step of performing a remediative step.

11. The method of claim 10 wherein the remediative step is selected from the group consisting of discontinuing the injection of the fluid into the well bore; injecting a different fluid into the well bore; pressure pulsing the injection of the fluid into the well bore; halting the injection of a proppant into the well bore; injecting a different proppant into the well bore; injecting a clear fluid into the well bore, then resuming the injection of proppant into the well bore; reducing the injection pressure of the fluid injected into the formation; and altering the viscosity of the fluid injected into the formation.

12. The method of claim 10 wherein all steps are performed in real time.

13. The method of claim 1 wherein the step of injecting a fluid comprises injecting a fluid into a region of the subterranean formation surrounding a well bore so as to maintain or increase the pressure in the formation.

14. The method of claim 13 wherein the fluid is selected from the group consisting of water and carbon dioxide.

15. The method of claim 13 wherein the step of determining at least one parameter comprises making a determination selected from the group consisting of: determining that the fluid injection is proceeding effectively; determining that a spurious event has occurred; determining that a formation event has occurred; determining the type of formation event that has occurred; determining whether a remediative step is necessary; and determining whether a remediative step that has been performed was successful.

16. The method of claim 13 wherein the step of determining at least one parameter comprises determining that a formation event has occurred and determining the type of formation event that has occurred, wherein the step of determining the type of formation event that has occurred comprises the step of making a determination selected from the group consisting of: determining that the fluid has reached a boundary within the formation, and determining that the fluid has departed from the zone of interest within the formation.

17. The method of claim 14 further comprising the additional step of performing a remediative step.

18. The method of claim 17 wherein the remediative step is selected from the group consisting of discontinuing the injection of the fluid into the well bore; injecting a different fluid into the well bore; pressure pulsing the injection of the fluid into the well bore; reducing the injection pressure of the fluid injected into the formation; and altering the viscosity of the fluid injected into the formation.

19. The method of claim 18 wherein all steps are performed in real time.

20. The method of claim 1 wherein the step of injecting a fluid comprises injecting a first fluid into a region of the subterranean formation surrounding a well bore so as to alter the flow profile of a second fluid within the subterranean formation.

21. The method of claim 20 wherein the step of determining at least one parameter comprises making a determination selected from the group consisting of: determining that the injection of the first fluid is proceeding effectively; determining that a spurious event has occurred; determining that a formation event has occurred; determining the type of formation event that has occurred; determining whether a remediative step is necessary; and determining whether a remediative step that has been performed was successful.

22. The method of claim 20 wherein the step of determining at least one parameter comprises determining that a formation event has occurred and determining the type of formation event that has occurred, wherein the step of determining the type of formation event that has occurred comprises the step of making a determination selected from the group consisting of: determining that the first fluid has reached a boundary within the formation, and determining that the first fluid has departed from the zone of interest within the formation.

23. The method of claim 21 further comprising the additional step of performing a remediative step.

24. The method of claim 23 wherein the remediative step is selected from the group consisting of discontinuing the injection of the fluid into the well bore; injecting a different fluid into the well bore; pressure pulsing the injection of the fluid into the well bore; reducing the injection pressure of the fluid injected into the formation; and altering the viscosity of the fluid injected into the formation.

25. The method of claim 23 wherein all steps are performed in real time.

26. The method of claim 1 wherein the step of creating frequency spectrum data comprises applying a wavelet from the Daubechies family of wavelets.

27. A computer-implemented method for monitoring the injection of fluid into a subterranean formation, comprising the steps of:

receiving in a computer physical property data obtained from the injection of a fluid into a region of a subterranean formation surrounding a well bore;

performing in the computer a Wavelet Transform on at least a portion of the physical property data received in the computer to provide frequency spectrum data corresponding to at least a portion of the physical property data; and using the frequency spectrum data to determine at least one parameter relating to the fluid injection process.

28. The method of claim 27 wherein the physical property data is selected from the group consisting of pressure data and temperature data.

29. The method of claim 27 wherein all steps are performed in real time.

30. The method of claim 27 further comprising the additional step of performing a remediative step.

31. The method of claim 30 wherein the remediative step is selected from the group consisting of: discontinuing the injection of a fracturing fluid into a well bore; injecting a, different fluid into a well bore; pressure pulsing the injection of a fluid into a well bore; halting the injection of a proppant into a well bore; injecting a different proppant into a well bore; injecting a clear fluid into a well bore, then resuming the injection of proppant into the well bore; reducing the injection pressure of a fluid injected into the formation; and altering the viscosity of a fluid injected into the formation.

32. The method of claim 30 further comprising the additional step of transmitting an output from the computer to perform the remediative step.

33. The method of claim 27 wherein the step of injecting a fluid comprises injecting a fluid into a region of the subterranean formation surrounding a well bore so as to create or extend at least one fracture in a subterranean formation.

34. The method of claim 33 wherein the step of determining at least one parameter comprises making a determination selected from the group consisting of: determining that the fracture is being extended by the injection of the fluid; determining that a spurious event has occurred; determining that a formation event has occurred; determining the type of formation event that has occurred; determining whether a remediative step is necessary; and determining whether a remediative step that has been performed was successful.

35. The method of claim 33 wherein the step of determining at least one parameter comprises determining that a formation event has occurred, comprising making a determination selected from the group consisting of: determining that the fracture has ceased to extend and determining that the fracture has closed.

36. The method of claim 34 wherein the step of determining at least one parameter further comprises the step of utilizing a log-log plot of a net pressure curve.

37. The method of claim 34 further comprising the additional step of performing a remediative step.

38. The method of claim 37 wherein the remediative step is selected from the group consisting of: discontinuing the injection of a fracturing fluid into a well bore; injecting a different fluid into a well bore; pressure pulsing the injection of a fluid into a well bore; halting the injection of a proppant into a well bore; injecting a different proppant into a well bore; injecting a clear fluid into a well bore, then resuming the injection of proppant into the well bore; reducing the injection pressure of a fluid injected into the formation; and altering the viscosity of a fluid injected into the formation.

39. The method of claim 38, further comprising the step of using an expert computer program to analyze the frequency spectrum data, and wherein the remediative step is suggested by the expert computer program.

40. The method of claim 37 wherein all steps are performed in real time.

41. The method of claim 37 further comprising the additional step of transmitting an output from the computer to perform the remediative step.

42. The method of claim 27 wherein the step of injecting a fluid comprises injecting a fluid into a region of the subterranean formation surrounding a well bore so as to maintain or increase the pressure in the formation.

43. The method of claim 42 wherein the fluid is selected from the group consisting of water and carbon dioxide.

44. The method of claim 42 wherein the step of using the frequency spectrum data to determine at least one parameter comprises making a determination selected from the group consisting of: determining that the fluid injection is proceeding effectively; determining that a spurious event has occurred; determining that a formation event has occurred; determining the type of formation event that has occurred; determining whether a remediative step is necessary; and determining whether a remediative step that has been performed was successful.

45. The method of claim 42 wherein the step of determining at least one parameter comprises determining that a formation event has occurred and determining the type of formation event that has occurred, wherein the step of determining the type of formation event that has occurred comprises the step of making a determination selected from the group consisting of: determining that the fluid has reached a boundary within the formation, and determining that the fluid has departed from the zone of interest within the formation.

46. The method of claim 43 further comprising the additional step of performing a remediative step.

47. The method of claim 46 wherein the remediative step is selected from the group consisting of: discontinuing the injection of a fracturing fluid into a well bore; injecting a different fluid into a well bore; pressure pulsing the injection of a fluid into a well bore; reducing the injection pressure of a fluid injected into the formation; and altering the viscosity of a fluid injected into the formation.

48. The method of claim 47, further comprising the step of using an expert computer system to analyze the frequency data, and wherein the remediative step is suggested by the expert computer system.

49. The method of claim 46 wherein all steps are performed in real time.

50. The method of claim 46 further comprising the additional step of transmitting an output from the computer to perform the remediative step.

51. The method of claim 27 wherein the step of injecting a fluid comprises injecting a first fluid into a region of the subterranean formation surrounding a well bore so as to alter the flow profile of a second fluid within the subterranean formation.

52. The method of claim 51 wherein the step of using the frequency spectrum data to determine at least one parameter comprises making a determination selected from the group consisting of: determining that the injection of the first fluid is proceeding effectively; determining that a spurious event has occurred; determining that a formation event has occurred; determining the type of formation event that has occurred; determining whether a remediative step is necessary; and determining whether a remediative step that has been performed was successful.

53. The method of claim 51 wherein the step of determining at least one parameter comprises determining that a formation event has occurred and determining the type of formation event that has occurred, wherein the step of determining the type of formation event that has occurred comprises the step of making a determination selected from the group consisting of: determining that the first fluid has reached a boundary within the formation, and determining that the first fluid has departed from the zone of interest within the formation.

54. The method of claim 52 further comprising the additional step of performing a remediative step.

55. The method of claim 54 wherein the remediative step is selected from the group consisting of: discontinuing the injection of a fracturing fluid into a well bore; injecting a different fluid into a well bore; pressure pulsing the injection of a fluid into a well bore; reducing the injection pressure of a fluid injected into the formation; and altering the viscosity of a fluid injected into the formation.

56. The method of claim 55 further comprising the step of using an expert computer program to analyze the frequency data, and wherein the remediative step is suggested by the expert computer program.

57. The method of claim 54 wherein all steps are performed in real time.

58. The method of claim 54 further comprising the additional step of transmitting an output from the computer to perform the remediative step.

59. The method of claim 27 wherein the step of performing in the computer a wavelet transform comprises applying a wavelet from the Daubechies family of wavelets.

60. A method of fracturing a subterranean formation comprising the steps of:

injecting a fracturing fluid into the subterranean formation such that a fracture is created or extended in a region of the formation surrounding a well bore and generates pressure signals;

sensing the pressure signals;

generating frequency signals corresponding to the pressure signals by applying a wavelet transform to the pressure signals; and determining from the frequency signals whether the fracture is continuing to extend into the formation.

61. The method of claim 60 wherein the step of determining whether the fracture is continuing to extend into the formation comprises distinguishing between a formation event and spurious data.

62. The method of claim 60 wherein the step of determining whether the fracture is continuing to extend into the formation comprises distinguishing between the cessation of propagation of the fracture, and fracture closure.

63. The method of claim 60 further comprising the step of performing a remediative step after determining that the fracture is not continuing to extend.

64. The method of claim 60 wherein all steps are performed in real time.

65. The method of claim 60 wherein the step of generating frequency signals corresponding to the pressure signals by applying a Wavelet Transform to the pressure signals comprises applying a wavelet from the Daubechies family of wavelets.

66. The method of claim 63 wherein the remediative step is selected from the group consisting of: discontinuing the injection of a fracturing fluid into a well bore; injecting a different fluid into a well bore; pressure pulsing the injection of a fluid into a well bore; injecting a different proppant into a well bore; halting the injection of proppant, and injecting a clear fluid into the well bore, then resuming the injection of proppant into the well bore.

67. The method of claim 63 wherein the step of performing a remediative step after determining that the fracture is not continuing to extend is performed before the fracture closes.

68. The method of claim 60 wherein the step of determining whether the fracture is continuing to extend into the formation further comprises utilizing a log-log plot of a net pressure curve.

69. The method of claim 60 wherein the step of determining whether the fracture is continuing to extend into the formation further comprises utilizing an expert computer program.

70. The method of claim 69 further comprising the step of performing a remediative step after determining that the fracture is not continuing to extend, wherein the remediative step is suggested by the expert computer program.

71. A method of flooding a subterranean formation, comprising the steps of:

injecting a fluid into a region of the subterranean formation surrounding a well bore so as to maintain or increase the pressure in the formation;

creating frequency spectrum data by applying a wavelet transform to physical property data sensed in the subterranean formation during the time in which fluid is injected into the formation; and determining from the frequency spectrum data at least one parameter relating to the fluid injection.

72. The method of claim 71 wherein the physical property data is selected from the group consisting of pressure data and temperature data.

73. The method of claim 71 wherein the fluid is selected from the group consisting of water and carbon dioxide.

74. The method of claim 73 wherein the step of determining at least one parameter comprises making a determination selected from the group consisting of: determining that the fluid injection is proceeding effectively; determining that a spurious event has occurred; determining that a formation event has occurred; determining the type of formation event that has occurred; determining whether a remediative step is necessary; and determining whether a remediative step that has been performed was successful.

75. The method of claim 73 wherein the step of determining at least one parameter comprises determining that a formation event has occurred and determining the type of formation event that has occurred, wherein the step of determining the type of formation event that has occurred comprises the step of making a determination selected from the group consisting of: determining that the fluid has reached a boundary within the formation, and determining that the fluid has departed from the zone of interest within the formation.

76. The method of claim 74 further comprising the additional step of performing a remediative step.

77. The method of claim 76 wherein the remediative step is selected from the group consisting of discontinuing the injection of the fluid into the well bore; injecting a different fluid into the well bore; pressure pulsing the injection of the fluid into the well bore; reducing the injection pressure of the fluid injected into the formation; and altering the viscosity of the fluid injected into the formation.

78. The method of claim 77 wherein all steps are performed in real time.

79. A method of conforming a fluid flow profile in a subterranean formation, comprising the steps of:

injecting a first fluid into a region of the subterranean formation surrounding a well bore so as to alter the flow profile of a second fluid within the formation;

creating frequency spectrum data by applying a wavelet transform to physical property data sensed in the subterranean formation during the time in which fluid is injected into the formation; and determining from the frequency spectrum data at least one parameter relating to the fluid injection.

80. The method of claim 79 wherein the physical property data is selected from the group consisting of pressure data and temperature data.

81. The method of claim 79 wherein the step of determining at least one parameter comprises making a determination selected from the group consisting of: determining that the fluid injection is proceeding effectively; determining that a spurious event has occurred; determining that a formation event has occurred; determining the type of formation event that has occurred; determining whether a remediative step is necessary; and determining whether a remediative step that has been performed was successful.

82. The method of claim 79 wherein the step of determining at least one parameter comprises determining that a formation event has occurred and determining the type of formation event that has occurred, wherein the step of determining the type of formation event that has occurred comprises the step of making a determination selected from the group consisting of: determining that the fluid has reached a boundary within the formation, and determining that the fluid has departed from the zone of interest within the formation.

83. The method of claim 81 further comprising the additional step of performing a remediative step.

84. The method of claim 83 wherein the remediative step is selected from the group consisting of discontinuing the injection of the fluid into the well bore; injecting a different fluid into the well bore; pressure pulsing the injection of the fluid into the well bore; reducing the injection pressure of the fluid injected into the formation; and altering the viscosity of the fluid injected into the formation.

85. The method of claim 84 wherein all steps are performed in real time.

86. A system for monitoring the injection of fluid into a subterranean formation, comprising:

means for injecting the fluid into the subterranean formation;

sensing means for detecting physical property data created by the fluid injection;

data analysis means for creating frequency spectrum data by performing a wavelet transform on at least a portion of the physical property data; and transmitting means for transmitting the physical property data from the sensing means to the data analysis means.

87. The system of claim 86 wherein the physical property data is selected from the group consisting of temperature and pressure data.

88. The system of claim 86 wherein the data analysis means further determines from the frequency spectrum data at least one parameter relating to the fluid injection.

89. The system of claim 88 wherein the at least one parameter determined by the data analysis means is selected from the group consisting of: a determination that the fluid injection is proceeding effectively; a determination that a spurious event has occurred; a determination that a formation event has occurred; a determination the type of formation event that has occurred; a determination whether a remediative step is necessary; and a determination whether a remediative step that has been performed was successful.

90. A system for monitoring the injection of fluid into a subterranean formation, comprising:

a sensor for detecting physical property data created by the fluid injection;

a data analyzer for creating frequency spectrum data by performing a wavelet transform on at least a portion of the physical property data; and a transmitter for transmitting the physical property data from the sensor to the data analyzer.

* * * * *